US007507943B2

(12) United States Patent
Ichikawa et al.

(10) Patent No.: US 7,507,943 B2
(45) Date of Patent: Mar. 24, 2009

(54) LIGHT SOURCE FOR LCD WITH INDIVIDUALLY CONTROLLED SECTIONS

(75) Inventors: Hiroaki Ichikawa, Kanagawa (JP); Kenichi Kikuchi, Kanagawa (JP); Kimio Hatajiri, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/975,368

(22) Filed: Oct. 18, 2007

(65) Prior Publication Data

US 2008/0121780 A1 May 29, 2008

(30) Foreign Application Priority Data

Oct. 19, 2006 (JP) ..... P2006-285086

(51) Int. Cl.
*H01J 40/14* (2006.01)
*G02F 1/13* (2006.01)

(52) U.S. Cl. ..... 250/205; 250/214 R; 349/61; 345/207

(58) Field of Classification Search ..... 250/204, 250/205, 214 SW, 214 R; 349/24, 61; 345/204, 345/207, 690
See application file for complete search history.

(56) References Cited

U.S. PATENT DOCUMENTS 5,731,794 A 3/1998 Miyazawa et al.
6,069,676 A 5/2000 Yuyama et al.
6,744,416 B2 * 6/2004 Mizutani et al. ..... 345/88
2005/0116921 A1 6/2005 Kim

FOREIGN PATENT DOCUMENTS

| | | | |
|---|---|---|---|
| JP | 3-278023 | A | 12/1991 |
| JP | 10-049074 | A | 2/1998 |
| JP | 2000-294026 | A | 10/2000 |
| JP | 2004-013244 | | 1/2004 |
| JP | 2005-208486 | A | 8/2005 |
| JP | 2005-302737 | A | 10/2005 |
| JP | 2006-267167 | A | 10/2006 |
| JP | 2007-287422 | A | 11/2007 |
| WO | 02/37454 | | 5/2002 |
| WO | 2005/057275 | A1 | 6/2005 |
| WO | 2005/111976 | A1 | 11/2005 |

* cited by examiner

*Primary Examiner*—Kevin Pyo
(74) *Attorney, Agent, or Firm*—Lerner, David, Littenberg, Krumholz & Mentlik, LLP

(57) ABSTRACT

A light source device capable of further reducing fluctuations in the intensity or the like of illumination light with a simple configuration is provided. The light source device may include a light source including a plurality of lighting sections controllable independently of one another; a drive means for driving the light source so that the lighting sections are sequentially turned on; a light-sensing device receiving light from the light source in which the lighting sections are sequentially turned on; and a control means for controlling the drive means on the basis of a light receiving signal obtained by the light-sensing device from a specific lighting section so as to control the light emission amount of each lighting section.

14 Claims, 16 Drawing Sheets

FIG. 8A PERIOD T1
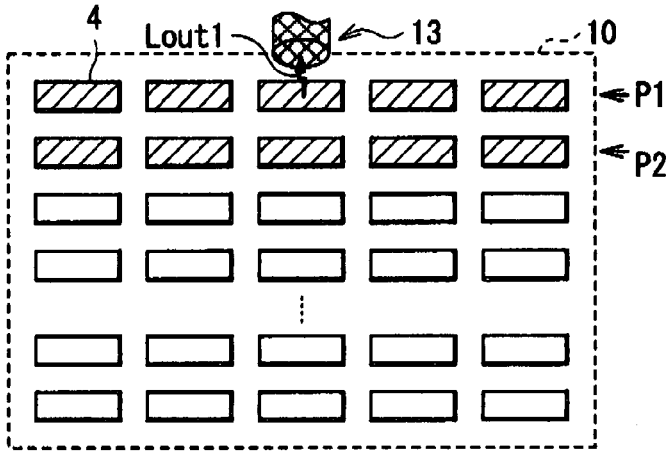
FIG. 8B PERIOD T2
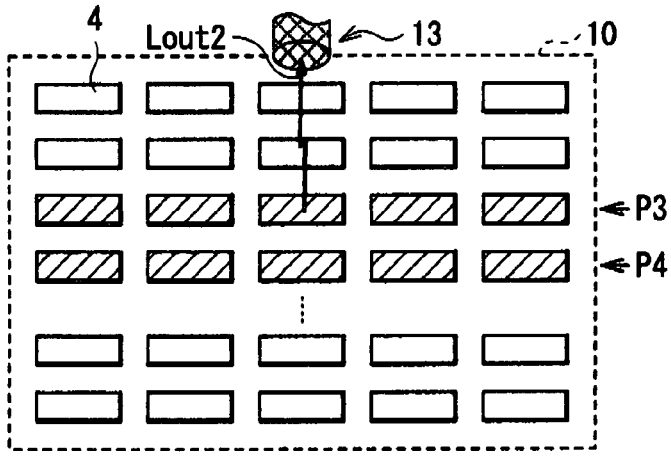
FIG. 8C PERIOD T(n/2)
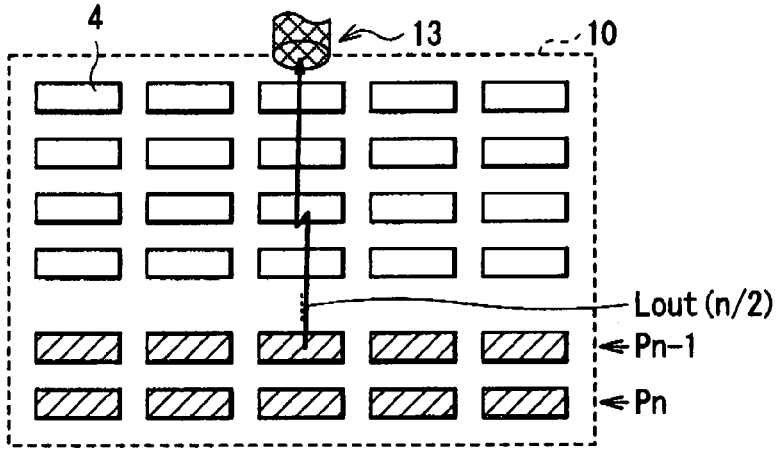

LIGHT SOURCE FOR LCD WITH INDIVIDUALLY CONTROLLED SECTIONS

CROSS-REFERENCE TO RELATED APPLICATIONS

This application claims priority from Japanese Patent Application No. JP 2006-285086 filed in the Japanese Patent Office on Oct. 19, 2006, the entire content of which is incorporated herein by reference.

BACKGROUND OF THE INVENTION

1. Field of the Invention

The present invention relates to a light source device having a plurality of lighting regions which are controllable independently of one another, a light source driving device and a light emission amount control device applied to such a light source device, and a liquid crystal display using such a light source device.

2. Description of the Related Art

In recent years, flat panel displays as typified by liquid crystal TVs and plasma display panels (PDPs) have become a trend, and among them, most of mobile displays are liquid crystal displays, and precise color reproducibility is desired in the mobile displays. Moreover, as backlights for liquid crystal panels, CCFLs (Cold Cathode Fluorescent Lamps) using fluorescent tubes are mainstream; however, mercury-free light sources are environmentally desired, so light emitting diodes (LEDs) and the like hold promise as light sources replacing CCFLs.

In such an LED backlight system, to improve video response of a liquid crystal panel, a light source section includes a plurality of separate lighting sections so as to approximate the impulse-type drive of a CRT (Cathode Ray Tube), thereby the light source section carries out sequential lighting operation (blinking operation) in which the plurality of lighting sections are sequentially turned on on a horizontal line basis. It is considered that compared to a CCFL backlight system, the LED backlight system is suitable for the sequential lighting operation, because the LED backlight system has good response when switching between a lighting-on state and a lighting-off state, and the LED backlight system does not have afterglow characteristics.

Further, in the LED backlight system, when a light-sensing device detects illumination light, and the light emission amount of the LED is controlled by a detected value, fluctuations in the intensity of illumination light can be reduced. In addition, in the case of an additive process backlight system which uses a plurality kinds of LEDs such as a red LED, a green LED and a blue LED to obtain a specific color light by mixing a plurality of color lights, in addition to fluctuations in the intensity of illumination light, fluctuations in the chromaticity of illumination light can be reduced by the same feedback system.

For example, Japanese Unexamined Patent Application Publication No. 2005-208486 discloses a technique in which when the LED backlight system performs sequential lighting operation (in this case, sequential light-off), the light emission amount of each LED group (each lighting section) is controlled based on information of the light amount variations detected by a photosensor section.

SUMMARY OF THE INVENTION

In the case where the light emission amount of an LED is controlled by a feedback system using a light-sensing device in the above-described manner, in a backlight system performing sequential lighting operation, there is an issue of where to arrange the light-sensing device relative to the light source section. In the case where sequential lighting operation is performed, a distance from the light-sensing device to each lighting section is different, so the light amount received by the light-sensing device is changed depending on the position of the lighting section which is turned on. In the case where the light amount received by the light-sensing device is continually changed depending on the position of the lighting section which is turned on, it is difficult to keep the intensity or the chromaticity of illumination light constant on the basis of the light reception amount.

Japanese Unexamined Patent Application Publication No. 2005-208486 (refer to Example 2 and FIG. 7 in Japanese Unexamined Patent Application Publication No. 2005-208486) discloses a technique in which a light guide guiding light emitted from an LED to a photosensor is arranged in each LED group so as to reduce an error in the light amount caused by a difference in the distance between the photosensor to each LED group.

However, when the light guide is arranged in each LED group, a large number of light guides are necessary, so the number of parts increases, thereby manufacturing cost is increased.

Thus, in the technique in the related art, in the light source device performing sequential lighting operation using a plurality of lighting sections, it is difficult to further reduce fluctuations in the intensity or chromaticity of illumination light with a simple configuration.

In view of the foregoing, it is desirable to provide a light source device capable of further reducing fluctuations in the intensity or the like of illumination light with a simple configuration, a light source driving device and a light emission amount control device applied to such a light source device, and a liquid crystal display including such a light source device.

According to an embodiment of the invention, there is provided a light source device which may include a light source including a plurality of lighting sections controllable independently of one another; a drive means for driving the light source so that the lighting sections are sequentially turned on; a light-sensing device receiving light from the light source in which the lighting sections are sequentially turned on; and a control means for controlling the drive means on the basis of a light receiving signal obtained by the light-sensing device from a specific lighting section so as to control the light emission amount of each lighting section.

According to an embodiment of the invention, there is provided a light source driving device, being applied to a light source including a plurality of lighting sections controllable independently of one another, in which the light source driving device which may include a drive means for driving the light source so that the lighting sections are sequentially turned on; a light-sensing device receiving light from the light source in which the lighting sections are sequentially turned on; and a control means for controlling the drive means on the basis of a light receiving signal obtained by the light-sensing device from a specific lighting section so as to control the light emission amount of each lighting section.

According to an embodiment of the invention, there is provided a light emission amount control device, being applied to a light source device, the light source device including a light source and a drive means, the light source including a plurality of lighting sections controllable independently of one another, the drive means for driving the light source so that the lighting sections are sequentially turned on, in which the light emission amount control device may include a light-sensing device receiving light from the light source in which the lighting sections are sequentially turned on; and a control means for controlling the drive means on the basis of a light receiving signal obtained by the light-sensing device from a specific lighting section so as to control the light emission amount of each lighting section.

According to an embodiment of the invention, there is provided a liquid crystal display which may include an illumination means for emitting light; and a liquid crystal panel modulating the light emitted from the illumination means on the basis of an image signal, wherein the illumination means includes a light source including a plurality of lighting sections controllable independently of one another, a drive means for driving the light source so that the lighting sections are sequentially turned on, a light-sensing device receiving light from the light source in which the lighting sections are sequentially turned on, and a control means for controlling the drive means on the basis of a light receiving signal obtained by the light-sensing device from a specific lighting section so as to control the light emission amount of each lighting section.

In the light source device, the light source driving device, the light emission amount control device and the liquid crystal display according to the embodiment of the invention, light from the light source sequentially turning on the lighting sections may be received by the light-sensing device, and the drive means may be controlled on the basis of a light receiving signal obtained by the light-sensing device from a specific lighting section so as to control the light emission amount of each lighting section. Therefore, the magnitude of the light receiving signal may not be dependent on the distance from the light-sensing device and the lighting section which is turned on.

The light source device according to the embodiment of the invention may include a sampling means for sampling the light receiving signal from the light-sensing device at a timing in synchronization with a lighting period of the specific lighting section to supply the control means with the light receiving signal sampled. With such a configuration, the light receiving signal from the light-sensing device may be sampled in synchronization with the lighting period of the specific lighting section, and the light receiving signal may be supplied to the control means. Therefore, the drive means may be constantly controlled on the basis of the light receiving signal obtained by the light-sensing device from the specific lighting section.

Moreover, the light source device according to the embodiment of the invention may include a holding means for obtaining and holding the light receiving signal from the light-sensing device at a timing in synchronization with a lighting period of the specific lighting section; and a sampling means for sampling the light receiving signal held by the holding means to supply the control means with the light receiving signal sampled. In such a configuration, the light receiving signal may be held at a timing in synchronization with the specific lighting section, and the held light receiving signal may be sampled to be supplied to the control means. Therefore, in this case, irrespective of the sampling period of the sampling means, the drive means may be constantly controlled on the basis of the light receiving signal obtained by the light-sensing device from the specific lighting section.

The light source device according to the embodiment of the invention may be used as an illumination system for liquid crystal display modulating light from each lighting section, of which the light emission amount may be controlled by the above-described control means, on the basis of an image signal. In such a configuration, fluctuations in the intensity or chromaticity of a display light emitted from the liquid crystal panel can be reduced, so the image quality of a displayed image is improved.

In the light source device, the light source driving device, the light emission amount control device or the liquid crystal display according to the embodiment of the invention, light from the light source sequentially turning on the lighting sections may be received by the light-sensing device, and the drive means may be controlled on the basis of a light receiving signal obtained by the light-sensing device from a specific lighting section so as to control the light emission amount of each lighting section, so the magnitude of the light receiving signal can be independent on the distance between the light-sensing device and the lighting section which is turned on. Moreover, the complication of the configuration such as an increase in the number of parts is prevented. Therefore, fluctuations in the intensity or the like of the illumination light can be further reduced with a simple configuration.

Other and further objects, features and advantages of the invention will appear more fully from the following description.

BRIEF DESCRIPTION OF THE DRAWINGS

FIGS. 8A, 8B and 8C are schematic plan views for describing sequential lighting operation of the light source section and operation of receiving illumination light;

DETAILED DESCRIPTION

Preferred embodiments will be described in detail below referring to the accompanying drawings.

First Embodiment

Figure 1:
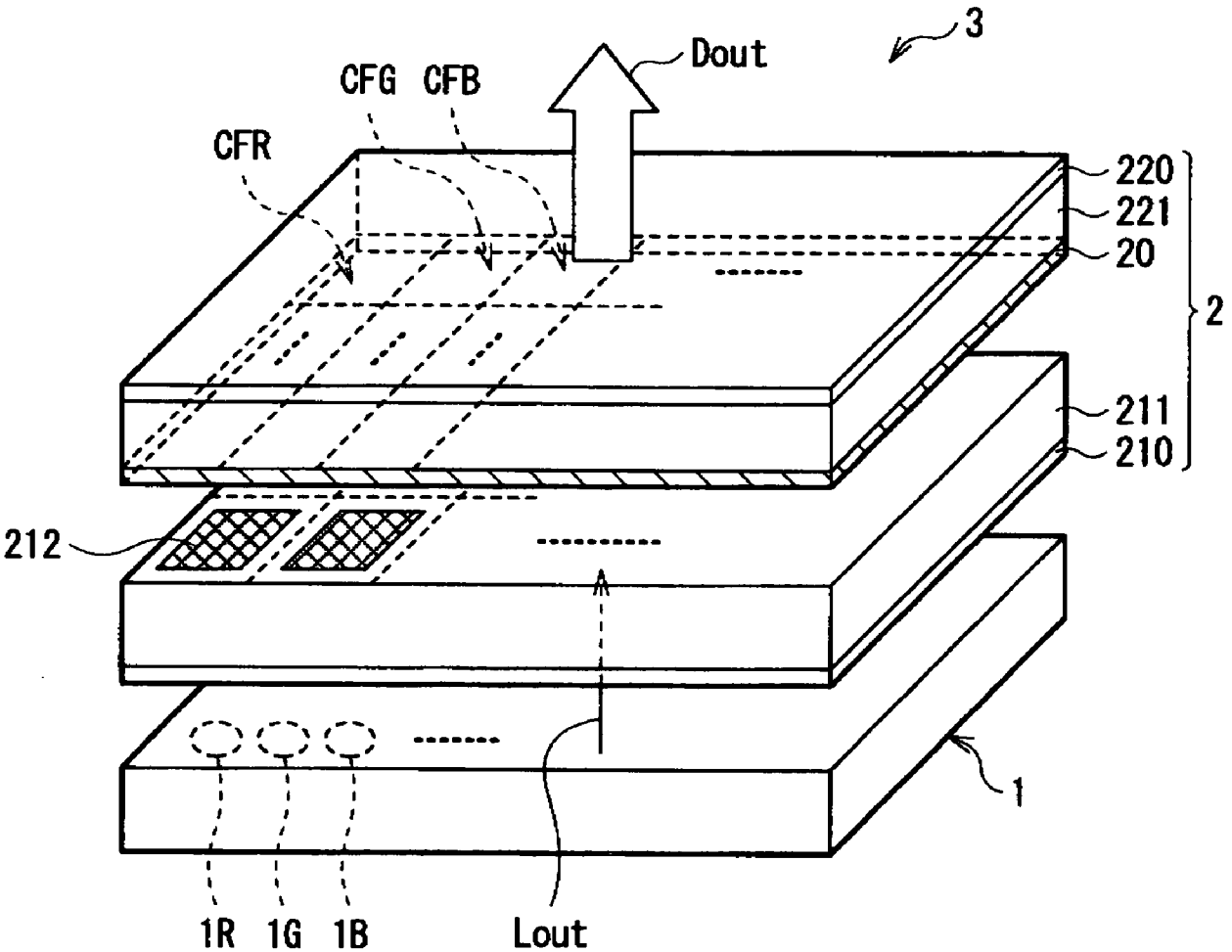
FIG. 1 is perspective view showing the whole configuration of a liquid crystal display according to a first embodiment of the invention.

FIG. 1 shows the whole configuration of a liquid crystal display (a liquid crystal display 3) according to a first embodiment of the invention. The liquid crystal display 3 is a so-called transmissive liquid crystal display emitting transmitted light as display light Dout, and includes a backlight system 1 as a light source device according to a first embodiment of the invention and a transmissive liquid crystal display panel 2.

The liquid crystal display panel 2 includes a transmissive liquid crystal layer 20, a pair of substrates between which the liquid crystal layer 20 is sandwiched, that is, a TFT (Thin Film Transistor) substrate 211 as a substrate on a side closer to the backlight system 1 and a facing electrode substrate 221 as a substrate facing the TFT substrate 211, and polarizing plates 210 and 220 laminated on a side of the TFT substrate 211 and a side of the facing electrode substrate 221 opposite to sides closer to the liquid crystal layer 20 is arranged, respectively.

Moreover, the TFT substrate 211 includes pixels in a matrix form, and in each pixel, a pixel electrode 212 including a driving device such as a TFT is formed.

The backlight system 1 is an additive process backlight system obtaining illumination light Lout as a specific color light (in this case, a white light) by mixing a plurality of color lights (in this case, a red light, a green light and a blue light), and includes a light source section (a light source section 10 which will be described later) including a plurality of red LEDs 1R, a plurality of green LEDs 1G and a plurality of blue LEDs 1B.

Figure 2A:
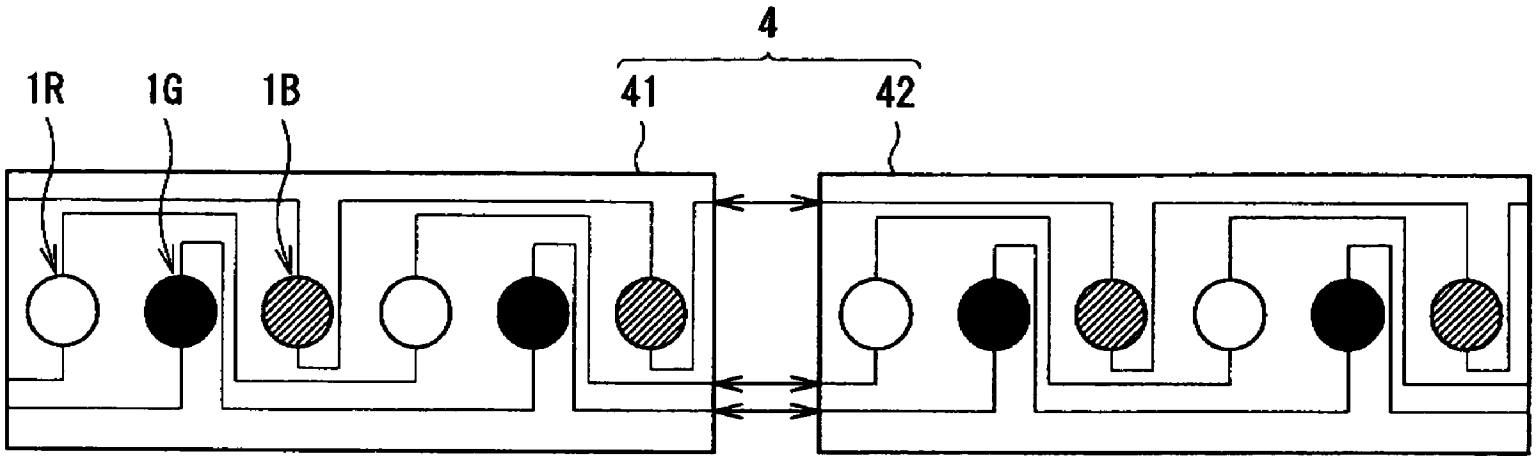
FIGS. 2A and 2B are schematic plan views showing a configuration example of a unit (a lighting section) of a light source section in a backlight system shown in FIG. 1.
Figure 2B:
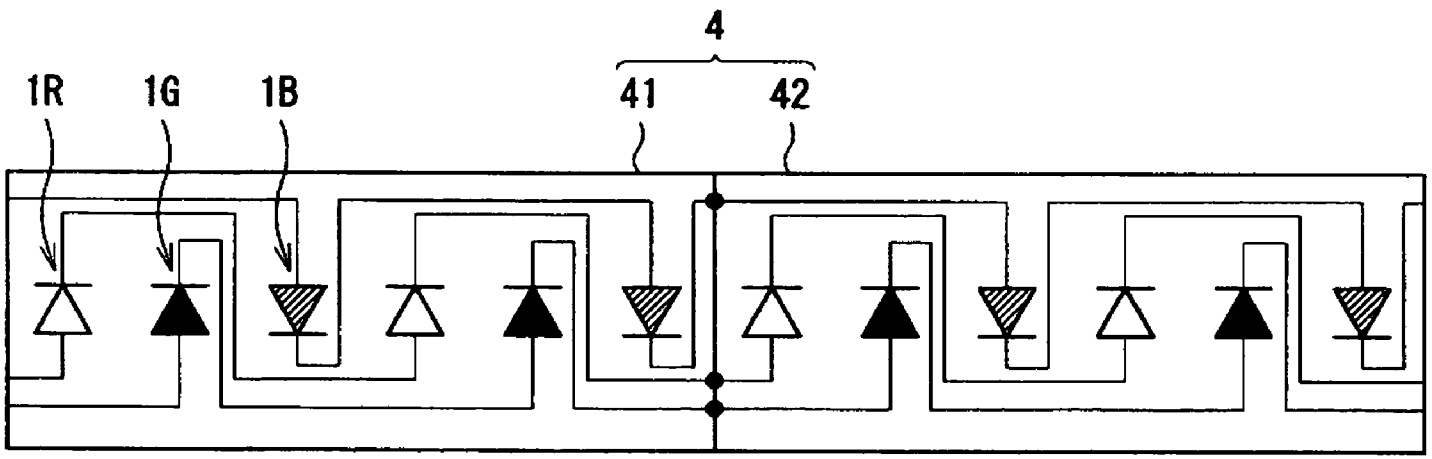
Figure 3:
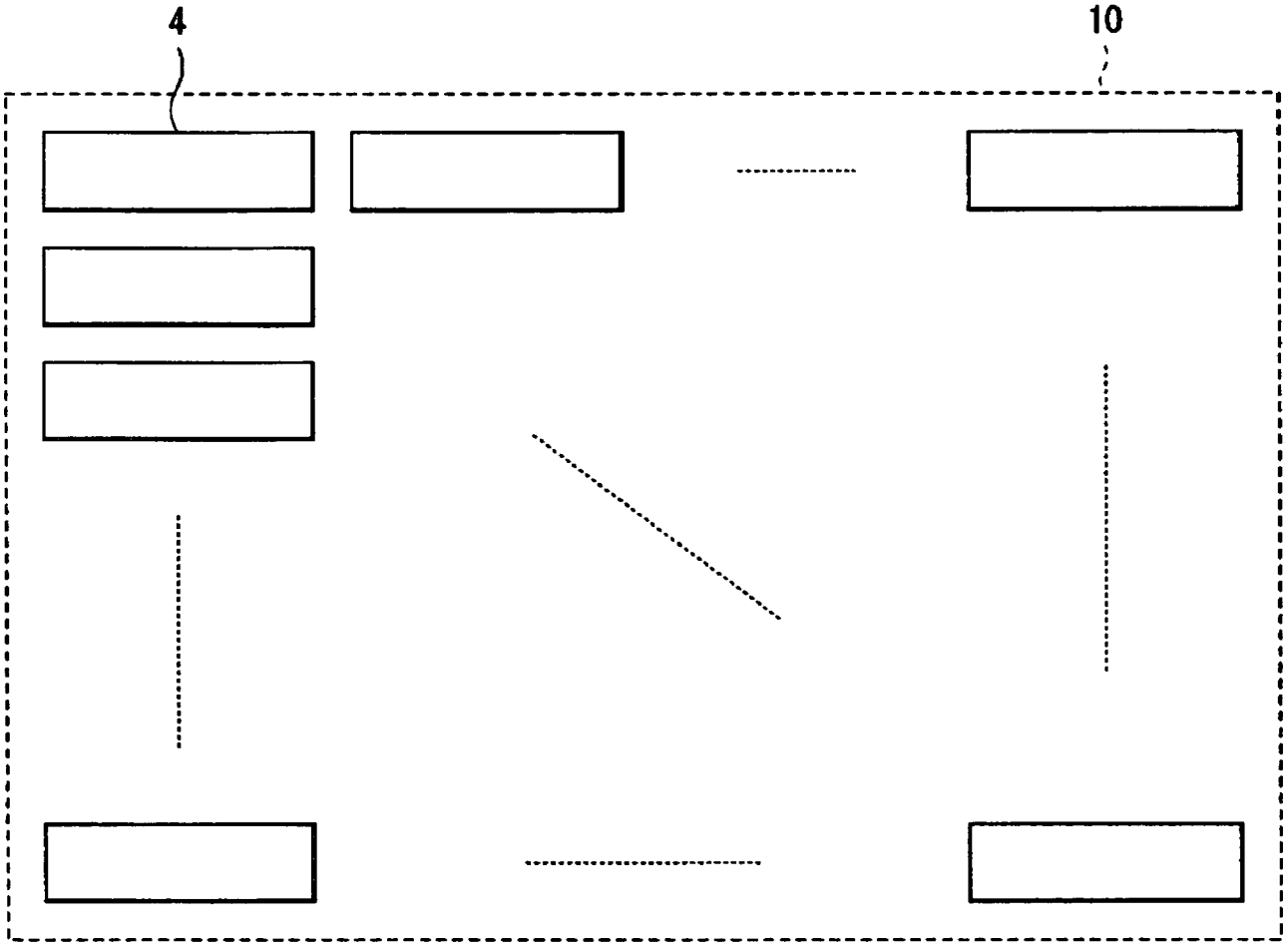
FIG. 3 is a schematic plan view showing an example of the arrangement of a lighting region in the light source section.

FIGS. 2A, 2B and 3 show an example of the arrangement of each LED in the backlight system 1.

As shown in FIG. 2A, in the backlight system 1, a pair of red LEDs 1R, a pair of green LEDs 1G and a pair of blue LEDs 1B constitute each of unit cells 41 and 42 in a light emitting section, and two unit cells 41 and 42 constitute a lighting section 4 as a unit of the light emitting section. Moreover, LEDs of each color are serially connected to one anther in each unit cell and between the unit cells 41 and 42. More specifically, as shown in FIG. 2B, an anode of an LED of each color is connected to a cathode of another LED of the same color.

For example, as shown in FIG. 3, the lighting sections 4 with such a configuration are arranged in a matrix form in the light source section 10, and as will be described later, the lighting sections 4 can be controlled independently of one another.

Figure 4:
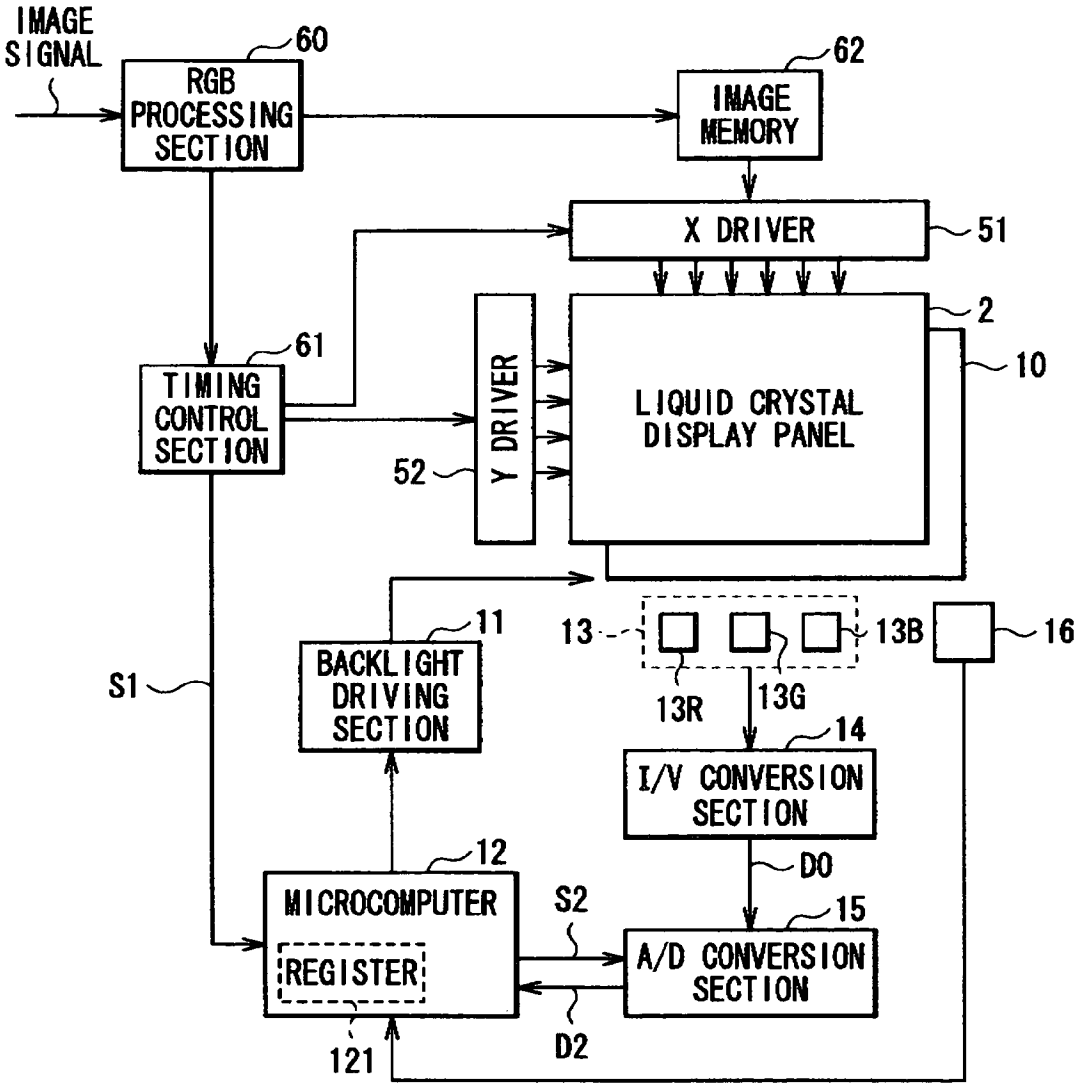
FIG. 4 is a block diagram showing the whole configuration of the liquid crystal display shown in FIG. 1.
Figure 5:
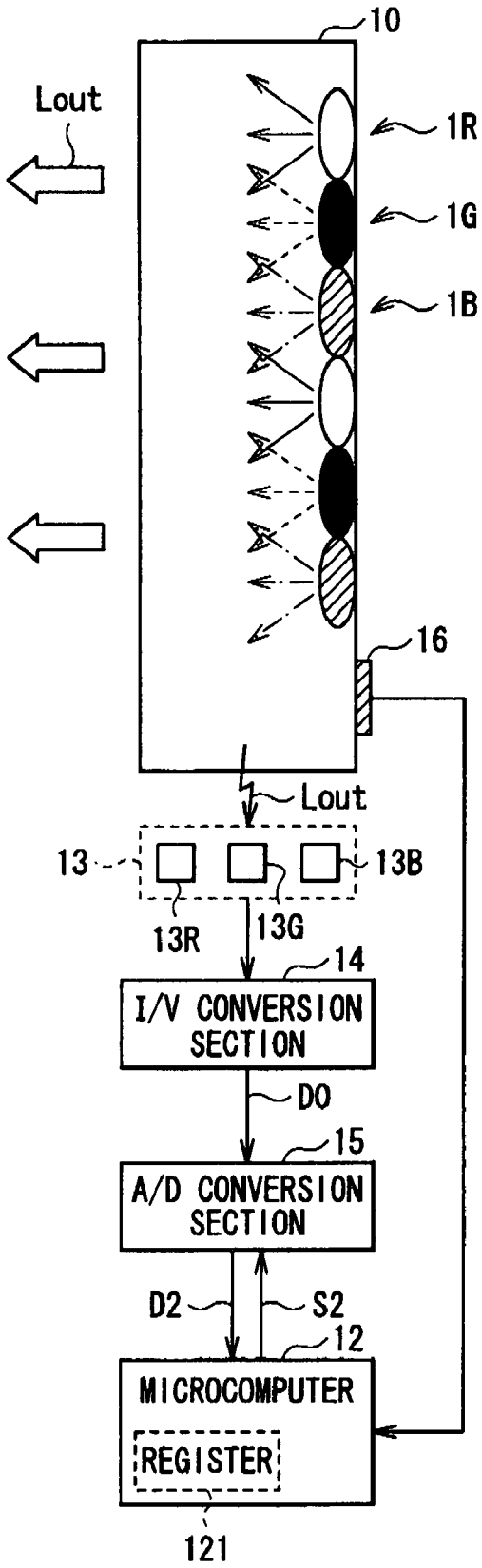
FIG. 5 is an illustration including a sectional view of the light source section and a block diagram of an example of a configuration receiving illumination light from the light source section.

Next, referring to FIGS. 4 and 5, the configurations of driving sections and control sections of the above-described liquid crystal display panel 2 and the above-described light source section 10 will be described in detail below. FIG. 4 shows a block diagram of the liquid crystal display 3, and FIG. 5 specifically shows a block diagram of the light source section 10 and its vicinity together with a sectional view of the light source section 10.

As shown in FIG. 4, a driving circuit for displaying an image by driving the liquid crystal display panel 2 includes an X driver (data driver) 51 supplying a drive voltage on the basis of an image signal to each pixel electrode 212 in the liquid crystal display panel 2, a Y driver (gate driver) 52 line-sequentially driving the pixel electrodes 212 in the liquid crystal panel 2 along a scanning line (not shown), a timing control section (a timing generator (TG)) 61 controlling the X driver 51 and the Y driver 52, an RGB processing section (a signal generator (SG)) 60 generating an RGB signal by processing an image signal from outside, and an image memory 62 as a frame memory storing the RGB signal from the RGB processing section 60.

On the other hand, a driving and control section for performing sequential lighting operation which will be described later by driving the light source section 10 of the backlight system 1 includes a backlight driving section 11, a microcomputer 12, a light-sensing section 13, an I/V conversion section 14, an A/D conversion section 15 and a temperature sensor 16.

The backlight driving section 11 drives the light source section 10 so as to perform line sequential lighting operation which will be described later in each lighting section 4. The specific configuration of the backlight driving section 11 will be described later (refer to FIG. 6).

The light-sensing section 13 obtains a light receiving signal by receiving illumination light Lout from the light source section 10, and includes a red light-sensing section 13R selectively extracting and receiving a red light from a mixed color light (in this case, a white light) produced by mixing a plurality of color lights (in this case, a red light, a green light and a blue light), a green light-sensing section 13G selectively extracting and receiving a green light from the mixed color light, and a blue light-sensing section 13B selectively extracting and receiving a blue light from the mixed color light. The temperature sensor 16 detects the temperature of the light source section 10. For example, as shown in FIG. 5, the light-sensing section 13 and the temperature sensor 16 are arranged in the vicinity of the light source section 10 (in this case, a bottom side or a back side of the light source section 10). The specific configuration of the light-sensing section 13 will be described later (refer to FIG. 6).

The I/V conversion section 14 performs I/V (current/voltage) conversion on each color light receiving signal obtained by the light-sensing section 13 so as to output light reception data D0 as an analog voltage signal of each color. The specific configuration of the I/V conversion section 14 will be described later (refer to FIG. 6).

The A/D conversion section 15 samples the light reception data D0 of each color outputted from the I/V conversion section 14 at a predetermined timing on the basis of a sampling signal S2 outputted from the microcomputer 12, and converts sampled light reception data D1 (not shown) of each color into light reception data D2 of each color as a digital voltage signal by A/D (analog/digital) conversion to supply the light reception data D2 of each color to the microcomputer 12.

The microcomputer 12 controls the driving operation of the backlight driving section 11 on the basis of the light reception data D2 of each color supplied from the A/D conversion section 15 and temperature detection data supplied from the temperature sensor 16. Moreover, although the detail will be described later, the microcomputer 12 generates and outputs the above-described sampling signal S2 on the basis of a synchronizing signal S1 (for example, a synchronizing signal (such as a vertical synchronizing signal Vsync) supplied from the timing control to the Y driver when displaying an image on the liquid crystal panel 2) supplied from the timing control section 61, and the microcomputer 12 adjusts the period of line sequential lighting operation (a lighting period) in the light source section 10 and a sampling period in the A/D conversion section 15. In addition, optimum values of the rising edge and the trailing edge of a signal used for generating the sampling signal S2 are stored as register values in a register 121 including a nonvolatile memory arranged in the microcomputer 12 in advance.

Figure 6:
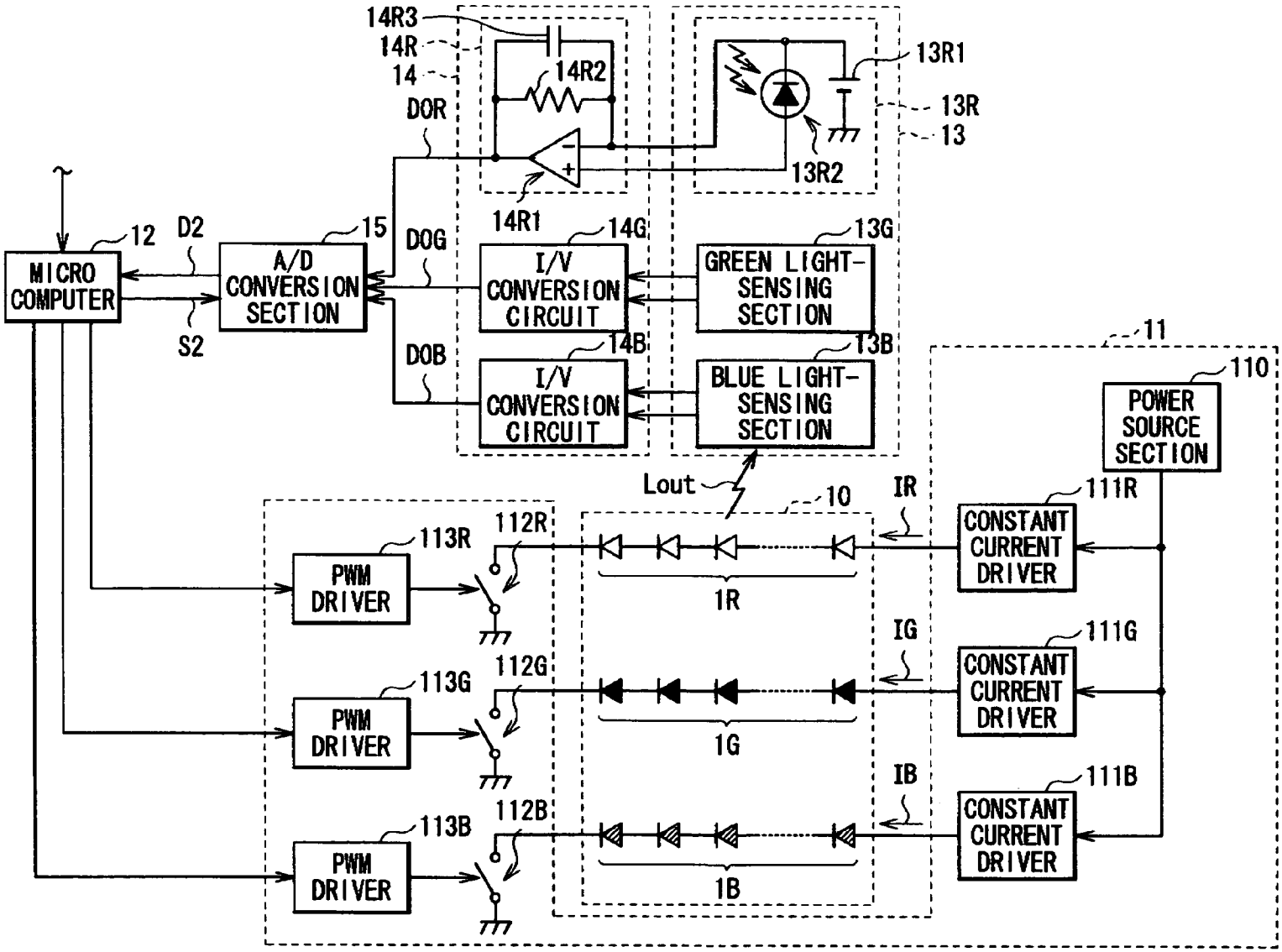
FIG. 6 is a block diagram showing detailed configurations of a driving section and a control section of the light source section shown in FIG. 4.

Next, referring to FIG. 6, the specific configurations of the backlight driving section 11, the light-sensing section 13 and the I/V conversion section 14 will be described below. FIG. 6 shows a block diagram of the specific configurations of the backlight driving section 11, the light-sensing section 13 and the I/V conversion section 14 and the A/D conversion section 15 and the microcomputer 12.

At first, the backlight driving section 11 includes a power source section 110, constant current drivers 111R, 111G and 111B supplying constant currents IR, IG and IB to the anodes of the red LEDs 1R, the green LEDs 1G and the blue LEDs 1B in the light source 10 by a power supplied from the power source section 110, respectively, switching devices 112R, 112G and 112B connected between the cathodes of the red LEDs 1R, the green LEDs 1G and the blue LEDs 1B and the ground, respectively, and PWM drivers 113R, 113G and 113B performing PWM (Pulse Width Modulation) control on the switching devices 112R, 112G and 112B on the basis of the control by the microcomputer 12, respectively. For convenience sake, it is shown that the red LEDs 1R, the green LEDs 1G and the blue LEDs 1B each are serially connected to one another in the light source section 10.

As described above, the light-sensing section 13 includes the red light-sensing section 13R, the green light-sensing section 13G and the blue light-sensing section 13B. Among them, the red light-sensing section 13R includes a DC power source 13R1 and a photodiode 13R2 as a photosensor selectively receiving a red light and generating a current according to the amount of the red light. The cathode of the photodiode 13R2 is connected to the DC power source 13R1, and the anode of the photodiode 13R2 is connected to a non-inverting input terminal of an operational amplifier 14R1 in the I/V conversion circuit 14R which will be described later. The green light-sensing section 13G and the blue light-sensing section 13B have the same configuration as that of the red light-sensing section 13R. In the red light-sensing section 13R, the green light-sensing section 13G and the blue light-sensing section 13B having such a configuration, in the photodiode for each color, each color light is extracted from the illumination light Lout from the light source section 10, and a current according to the amount of each color light is generated, and then the current is supplied to the I/V conversion section 14 as light reception data of a current value.

The I/V conversion section 14 includes IV conversion circuits 14R, 14G and 14B as I/V conversion circuits for each color. Among them, the red I/V conversion circuit 14R includes the operational amplifier 14R1, a resistor 14R2 and a capacitor 14R3. The non-inverting input terminal of the operational amplifier 14R1 is connected to an end of the resistor 14R2, an end of the capacitor 14R3 and the DC power source 13R1 and the cathode of the photodiode 13R2 in the red light-sensing section 13R. Moreover, the output terminal of the operational amplifier 14R1 is connected to an input terminal of the A/D conversion section 15. In the I/V conversion circuit 14R with such a configuration, light reception data of the current value supplied from the red light-sensing section 13R is converted into red light reception data D0R as light reception data of an analog voltage, and the red light reception data D0R is outputted to the A/D conversion section 15. The green I/V conversion circuit 14G and the blue I/V conversion circuit 14B have the same configuration as that of the red I/V conversion circuit 14R, and green light reception data DOG and blue light reception data DOB as light reception data of analog voltages are outputted to the A/D conversion section 15.

In the description, the backlight driving section 11 corresponds to a specific example of "a drive means" in the invention, the microcomputer 12 corresponds to a specific example of "a control means" in the invention, the light-sensing section 13 corresponds to a specific example of "a light-sensing device" in the invention, and the A/D conversion section 15 corresponds to a specific example of "a sampling means" in the invention. Moreover, the light-sensing section 13, the I/V conversion section 14, the A/D conversion section 15 and the microcomputer 12 correspond to specific examples of "a light emission amount control device" in the invention, the backlight driving section 11, the light-sensing section 13, the I/V conversion section 14, the A/D conversion section 15 and the microcomputer 12 correspond to specific examples of "a light source driving device" in the invention, the light source section 10, the backlight driving section 11, the light-sensing section 13, the I/V conversion section 14, the A/D conversion section 15 and the microcomputer 12 correspond to specific examples of "a backlight system" in the invention.

Next, the operations of the backlight system 1 with such a configuration and the liquid crystal display 3 according to the embodiment will be described in detail below.

Figure 7:
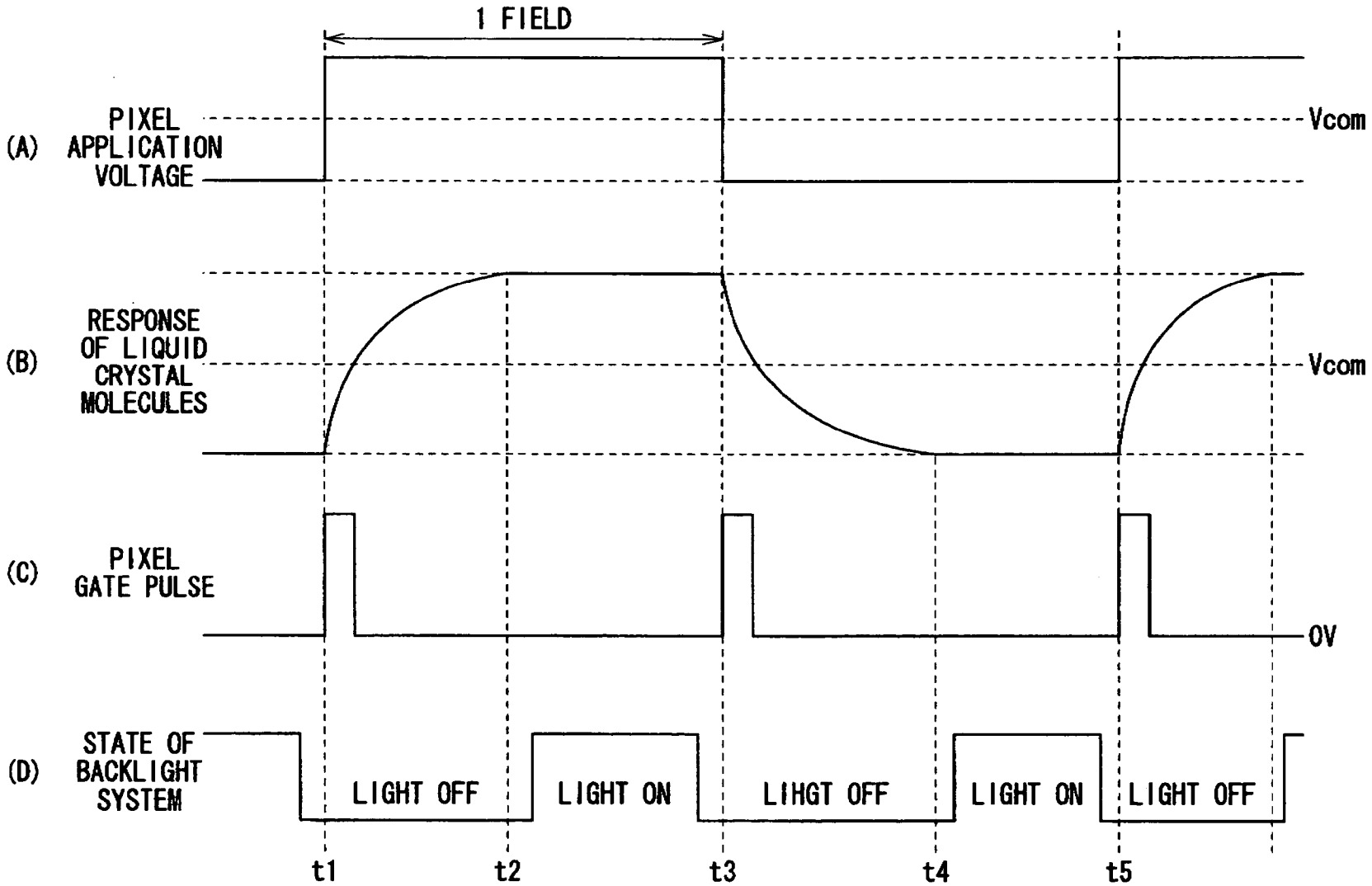
FIG. 7 is a timing waveform chart for describing an example of a method of driving a liquid crystal panel and the backlight system shown in FIG. 1.

At first, referring to FIGS. 1 to 8A, 8B and 8C, the basic operations of the backlight system 1 and the liquid crystal display 3 according to the embodiment will be described below. FIGS. 8A, 8B and 8C show schematic plan views showing line sequential lighting operation in the light source section 10 of the backlight system 1. Moreover, FIG. 7 shows a timing waveform chart briefly showing the operation of the whole liquid crystal display 3, and (A) shows a voltage (a drive voltage) applied from the X driver 51 to each pixel electrode 212 in the liquid crystal panel 2, (B) shows the response of liquid crystal molecules (an actual potential state in the pixel electrode 212) and (C) shows a voltage (a pixel gate pulse) applied from the Y driver 52 to the gate of a TFT device in the liquid crystal panel 2. In FIGS. 8A, 8B and 8C, the case where the light-sensing section 13 is arranged on the top end of the light source section 10 is described as an example.

In the backlight system 1, when the switching devices 112R, 112G and 112B in the backlight driving section 11 turns into an on state, the constant currents IR, IG and IB flow from the constant current drivers 111R, 111G and 111B to the red LEDs 1R, the green LEDs 1G and the blue LEDs 1B in the light source section 10, respectively, thereby a red light, a green light and blue light are emitted so as to emit the illumination light Lout as a mixed color light.

At this time, the synchronizing signal S1 is supplied from the timing control section 61 to the microcomputer 12, so the microcomputer 12 supplies a control signal based on the synchronizing signal S1 to the PWM drivers 113R, 113G and 113B, thereby the switching devices 112R, 112G and 112B turns into an on state at a timing in synchronization with the synchronizing signal S1, and the lighting periods of the red LEDs 1R, the green LEDs 1G and the blue LEDs 1B synchronize the synchronizing signal S1.

Therefore, in the light source section 10, for example, as shown in FIGS. 8A, 8B and 8C, the lighting sections 4 positioned on a predetermined number of horizontal lines (in this case, two horizontal lines) are sequentially turned on at each of periods T1 T2, . . . , T(n/2). More specifically, at first, in the period T1 shown in FIG. 8A, the lighting sections 4 positioned on horizontal lines indicated by P1 and P2 (hereinafter referred to as horizontal lines P1 and P2) are turned on to emit an irradiating light Lout1. Next, in the period T2, the lighting sections 4 positioned on horizontal lines indicated by P3 and P4 (hereinafter referred to as horizontal lines P3 and P4) are turned on to emit an irradiating light Lout2. Finally, the lighting sections 4 positioned on horizontal lines indicated by P(n-1) and P(n/2) (hereinafter referred to as horizontal lines P(n-1) and P(n/2)) are turned on to emit an irradiating light Lout(n/2).

Moreover, at this time, as shown in FIGS. 8A, 8B and 8C, the light-sensing section 13 receives the irradiating lights Lout1, Lout2, . . . , Lout(n/2) from the lighting sections 4 line-sequentially turned on. More specifically, as shown in FIG. 6, in the red light-sensing section 13R, the green light-sensing section 13G and the blue light-sensing section 13B in the light-sensing section 13, each color light is extracted from the irradiating light Lout from the light source section 10 by each color photodiode, and a current according to the amount of each color light is generated, thereby the light reception data of the current value is supplied to the I/V conversion section 14.

Next, in the I/V conversion section 14, the IV conversion circuits 14R, 14G and 14B for red, green and blue convert the light reception data of the current values for red, green and blue into the light reception data D0R, D0G and D0B as light reception data of analog voltages, respectively, and outputs the light reception data D0R, D0G and D0B to the A/D conversion section 15.

Next, in the A/D conversion section 15, at first, the red, green and blue light reception data D0R, D0G and D0B are sampled at a predetermined timing which will be described later on the basis of the sampling signal S2 outputted from the microcomputer 12 to be converted into red, green and blue light reception data D1R, D1G and D1B (not shown), respectively. Then, A/D conversion is performed on the sampled light reception data D1R, D1G and D1B, thereby light reception data D2 for each color as a digital voltage signal is supplied to the microcomputer 12.

Then, in the microcomputer 12, on the basis of the light reception data D2 for each color supplied from the A/D conversion section 15, the PWM drivers 113R, 113G and 113B are controlled so as to keep the intensity and chromaticity (color balance) of the irradiating light Lout constant, and the on period of the switching devices 112R, 112G and 112B, that is, the lighting periods of the LEDs 1R, 1G and 1B are adjusted. Thus, on the basis of the illumination light Lout from the light source section 10, the lighting periods of the LEDs 1R, 1G and 1B are controlled on a color basis, thereby the light emission amount of the illumination light Lout is controlled.

On the other hand, in the whole liquid crystal display 3 according to the embodiment, the illumination light Lout from the light source section 10 of the backlight system 1 is modulated in a liquid crystal layer 20 by drive voltages outputted from the X driver 51 and the Y driver 52 to the pixel electrodes 212 on the basis of an image signal, and the modulated illumination light Lout is outputted from the liquid crystal panel 2 as a display light Dout. Thus, the backlight system 1 functions as a backlight (an illumination system for liquid crystal display) of the liquid crystal display 3, thereby an image is displayed by the display light Dout.

More specifically, for example, as shown in FIG. 7(C), a pixel gate pulse is applied from the Y driver 52 to the gates of the TFT devices on one horizontal line in the liquid crystal panel 2, and at the same time, as shown in FIG. 7(A), a drive voltage on the basis of the image signal is applied from the X driver 51 to the pixel electrodes 212 on one horizontal line. At this time, as shown in FIG. 7(B), the response of the actual potential of the pixel electrodes 212 relative to a pixel application voltage (response of liquid crystal molecules) is delayed (while the pixel application voltage starts at a timing t1, the actual potential starts at a timing t2), and the backlight system 1 turns into a light-on state in a period from timings t2 to t3 in which the actual potential is equal to the pixel application voltage, thereby an image on the basis of an image signal is displayed on the liquid crystal display 3. In FIG. 7, the period from the timing t1 to t3 corresponds to one horizontal period, and in the next horizontal period from the timings t3 to t5, the same operation as that in one horizontal period from the timings t1 to t3 is performed, except that the pixel application voltage is inverted relative to a common potential Vcom to prevent burn-in on the liquid crystal display.

Figure 9:
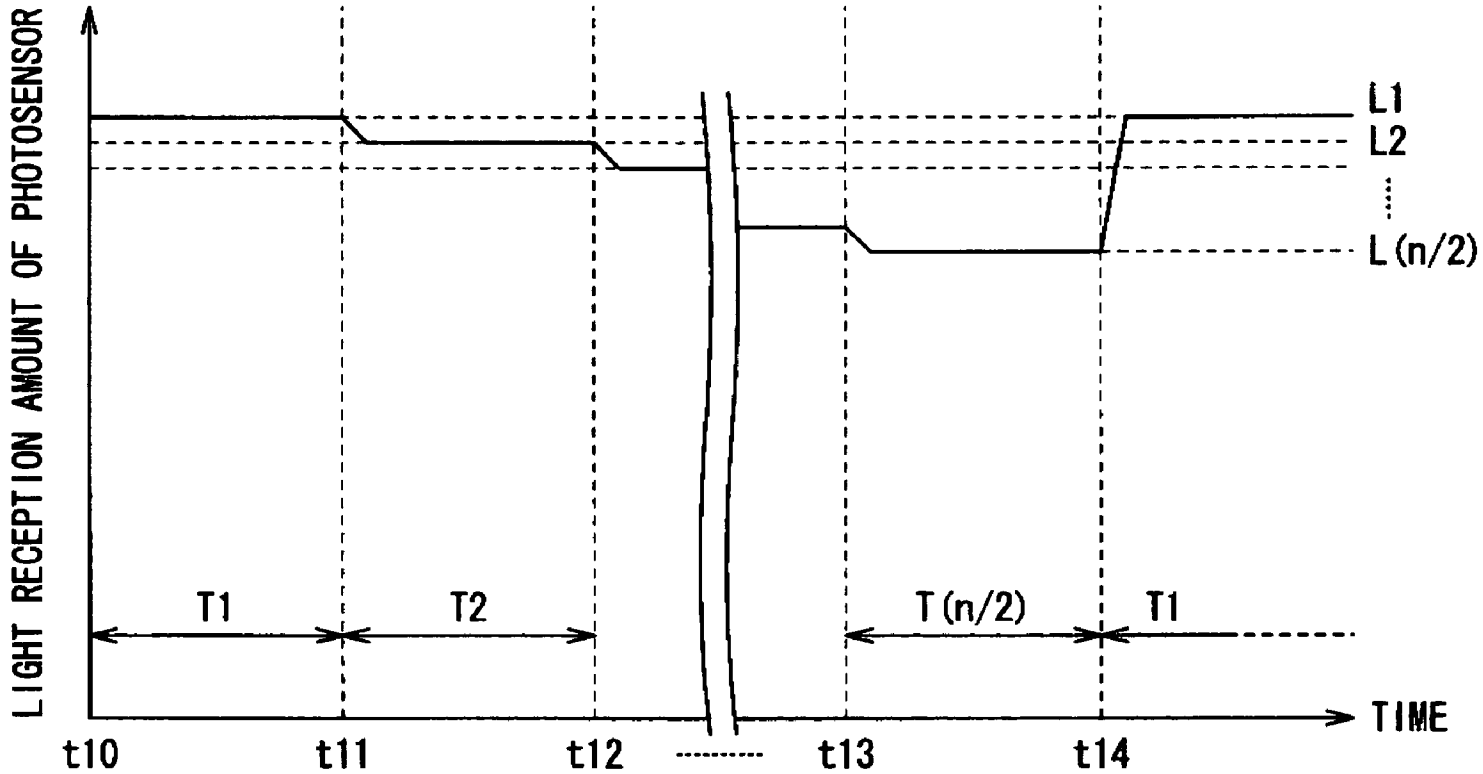
FIG. 9 is a plot for describing an example of a relationship between the light reception amount of a photosensor and the position of the lighting region.
Figure 10:
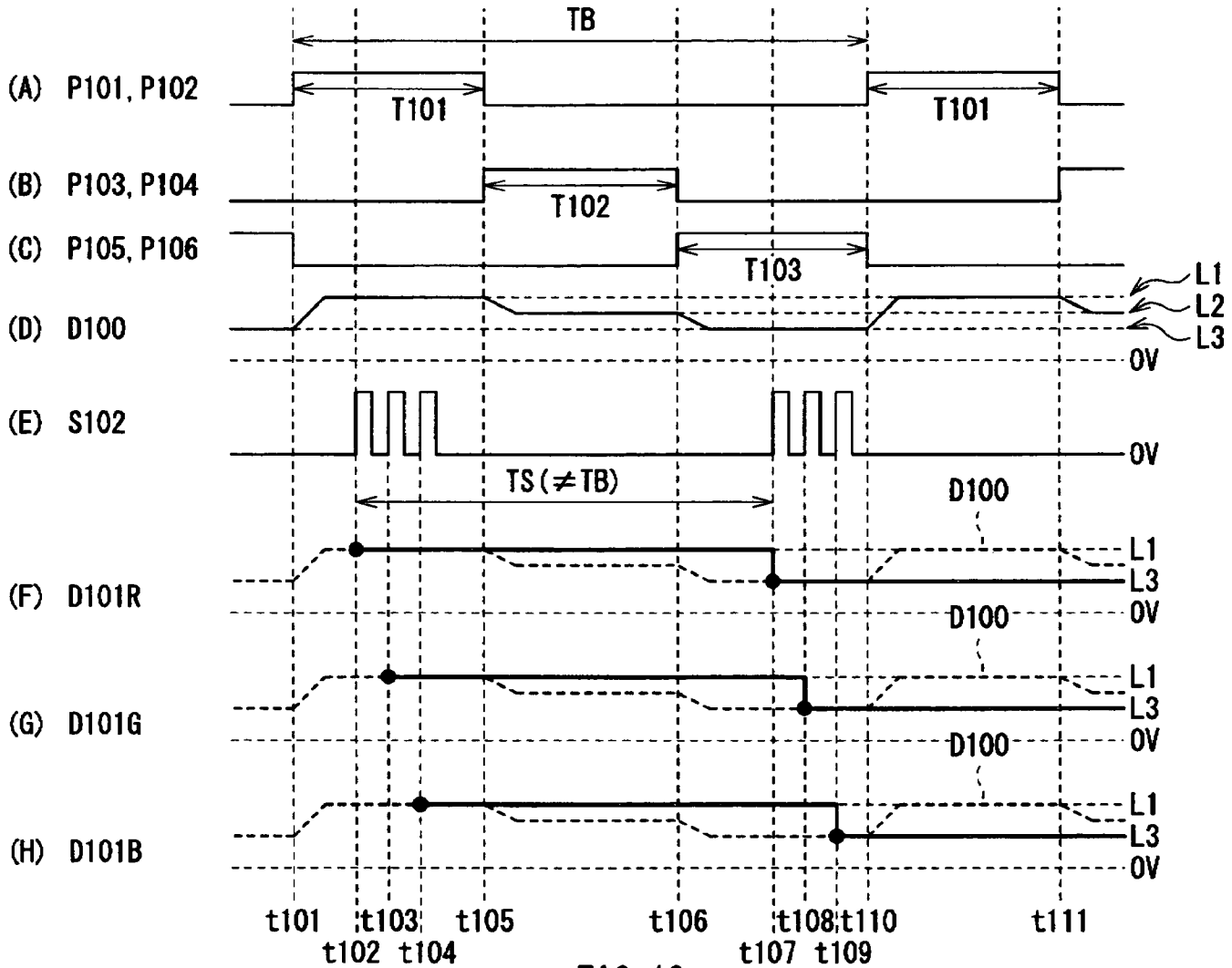
FIG. 10 RELATED ART
FIG. 10 is a timing waveform chart showing operation of a backlight system according to a comparative example.
Figure 11:
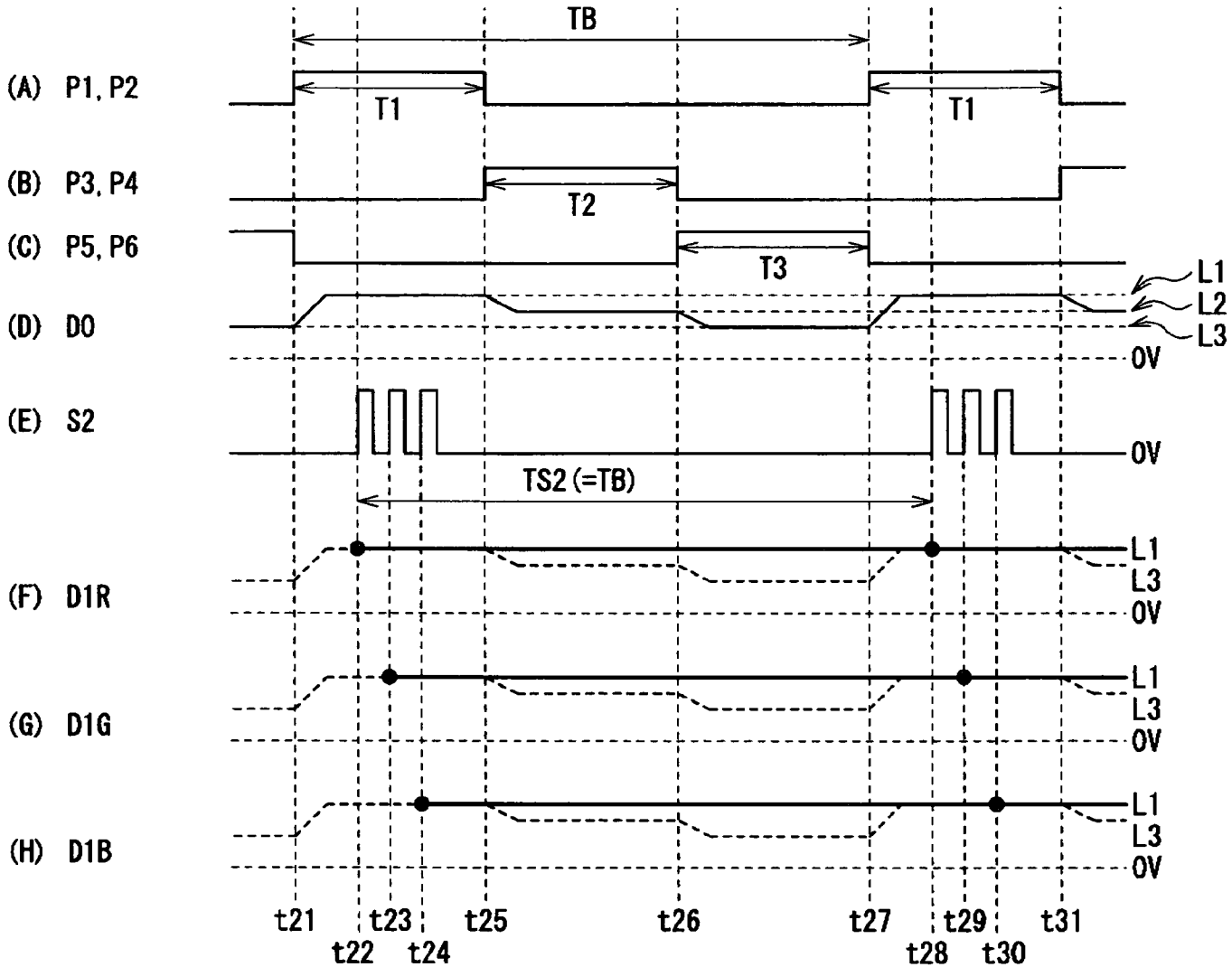
FIG. 11 is a timing waveform chart showing operation of the backlight system according to the first embodiment.

Next, referring to FIGS. 9 to 11 in addition to FIGS. 1 to 8A, 8B and 8C, the control operation of the backlight driving section 11 as one of characteristic parts of the embodiment of the invention will be described in detail below while comparing with a comparative example. FIG. 9 shows an example of a relationship between a light reception amount in a photosensor (a photodiode) in the light-sensing section 13 and the position of the lighting section 4, and in this case, as shown in FIGS. 8A, 8B and 8C, the case where the light-sensing section 13 is positioned on the top end of the light source section 10 is shown. FIG. 10 shows a timing waveform chart showing the operation of a backlight system (with the same configuration as that of the backlight system 1 according to the embodiment, except that the synchronizing signal S1 is not supplied from a timing control section to a microcomputer) in a related art according to the comparative example, and (A) to (C) show a lighting state ("H" indicates a light-on state and "L" indicates a light-off state) in horizontal lines P101 to P106 (not shown; corresponding to horizontal lines P1 to P6 in FIGS. 8A, 8B and 8C) arranged in order from the top end to the bottom end in a light source section, (D) shows a light receiving signal D100 (not shown; corresponding to the light reception data D0 in the embodiment) of an analog voltage inputted into an A/D conversion section, (E) shows a sampling signal S102 (not shown) of light reception data D100 supplied from the microcomputer to the A/D conversion section, and (F) to (G) show light reception data D101R, D101G and D101B (not shown) of analog voltages sampled in the A/D conversion section, respectively. FIG. 11 shows a timing waveform chart showing the operation of the backlight system 1 according to the embodiment, and (A) to (C) show a lighting state in the horizontal lines P1 to P6 shown in FIGS. 8A, 8B and 8C, (D) shows the light receiving signal D0 of an analog voltage inputted into the A/D conversion section 15, (E) shows the sampling signal S2 of the light reception data DO supplied from the microcomputer 12 to the A/D conversion section 15, and (F) to (G) show the light reception data D1R, D1G and D1B of analog voltages sampled in the A/D conversion section 15, respectively. In FIGS. 10 and 11, to simplify the description, six horizontal lines are arranged in the light source section, and three periods T1 to T3 (or periods T101 to T103) constitutes a lighting period (blinking period) TB of the lighting section in synchronization with one horizontal period of the liquid crystal display panel 2.

At first, in the backlight system 1 according to the embodiment and the backlight system according to the comparative example, for example, as shown in FIGS. 8A to 8C, the irradiating lights Lout1, Lout2, . . . , Lout(n/2) from the lighting sections 4 line-sequentially turned on are received by the light-sensing section 13. In this case, in the case where each lighting section 4 performs sequential lighting operation in such a manner, a distance from the light-sensing section 13 to each lighting section 4 is different; therefore, for example, as shown in FIG. 9, depending on the position of the lighting section 4 which is turned on (which horizontal line or which period the lighting section 4 is positioned), the amount of light received by the light-sensing section 13 is changed. More specifically, in the case of FIG. 9, in the period T1 (a period from timings t10 to t11), the photosensor obtains light reception data of the light amount L1 by the illumination light Lout1, in the period T2 (a period from timings t11 to t12), the photosensor obtains light reception data of the light amount L2 by the illumination light Lout2, and in the period T(n/2) (a period from timings t13 to t14), the photosensor obtains light reception data of the light amount L(n/2) by the illumination light Lout (n/2). In other words, even though the control section 12 controls the display light Lout to be constant as described above, the light reception amount in the photosensor is gradually reduced according to an increase in the distance between the light-sensing section 13 and the lighting section 14 which are turned on. Thus, in the case where the light reception amount is continually changed depending on the position of the lighting section 4 which is turned on, it is difficult to keep the intensity or chromaticity of the illumination light Lout constant on the basis of the light reception amount.

In the backlight system in a related art according to the comparative example shown in FIG. 10, the control operation of a backlight driving section is performed as below. More specifically, as shown in FIG. 10(E), a sampling signal S102 periodically turns into "H" at a predetermined timing, and light reception data D100 at this time is sampled to become light reception data D101R, D101G and D101B. The sampling signal S102 which turns into "H" at timings t102 to t104 corresponds to the sampling signals of red light reception data D100R, green light reception data D100G and blue light reception data D100B.

At this time, in the backlight system in the related art, as shown in FIG. 10, the lighting period (blinking period) TB of the lighting sections and the sampling period TS of the sampling signal S102 do not synchronize each other, and are different. Therefore, for example, at the timings t102 to t104, as shown in FIG. 10(F) to (H), the light reception data D100 on the basis of the irradiating light from the horizontal lines P101 and P102 corresponding to the period T101 is sampled to become the light reception data D101R, D101G and D101B, but on the other hand, at the timings t107 to t109 at which the sampling signal S102 is next supplied, the light reception data D100 on the basis of the irradiating light from the horizontal lines P105 and P106 corresponding to the period T103 is sampled to become the light reception data D101R, D101G and D101B. In other words, the lighting period TB and the sampling period TS do not synchronize each other, so the light reception data D101R, D101G and D101B sampled in the A/D conversion section is not constantly the light reception data D100 on the basis of the irradiating light from the lighting section positioned in a specific horizontal line, thereby the sampled light reception data D101R, D101G and D101B do not have a constant value, and are unstable.

In this case, for example, when a time constant CR by a resistance value and a capacity value increases in wiring between the I/V conversion section and the A/D conversion section, the light reception amount in the photosensor shown in FIG. 9 is equalized, and the values of the light reception data D101R, D101G and D101B are also equalized. However, in this case, due to a large time constant, it is difficult for the light-on/off operation of each lighting section to follow an image change such as displaying motion pictures. Moreover, in the case where a light guide is arranged between each lighting section and the light receiving section as described in a technique in Japanese Unexamined Patent Application Publication No. 2005-208486, the number of parts increases, thereby manufacturing cost is increased, and in addition to this, it is difficult to correctly align optical axes of a large number of light guides, so reliability may decline.

Therefore, in the backlight system 1 according to the embodiment, for example, the control operation of the backlight driving section 11 is performed as shown in FIG. 11. More specifically, unlike the comparative example, the lighting period (blinking period) TB of the lighting sections 4 and the sampling period TS2 of the sampling signal S2 synthesize each other, and are the same. Therefore, for example, at timings t21 to t23, as shown in FIG. 11(F) to (H), the light reception data D0 on the basis of the irradiating light from the horizontal lines P1 and P2 corresponding to the period T1 is sampled to become the light reception data D1R, D1G and D1B, and at timings t28 to t39 at which the sampling signal S2 is next supplied, the light reception data D0 on the basis of the irradiating light from the horizontal line P1 and P2 corresponding to the period T1 is sampled to become the light reception data D1R, D1G and D1B. In other words, the lighting period TB and the sampling period TS2 synchronize each other, so the light reception data D0 is sampled at a timing in synchronization with the lighting period TB of the lighting sections positioned in a specific horizontal line, thereby the light reception data D1R, D1G and D1B sampled in the A/D conversion section 15 constantly become the light reception data D1 on the basis of the irradiating light from the lighting sections positioned in the specific horizontal line, so the sampled light reception data D1R, D1G and D1B have a constant value, and are stable.

Thus, in the backlight system 1 according to the embodiment, the illumination light Lout from the light source section 10 sequentially turning on the lighting sections 4 is received by the light-sensing section 13, and the light reception data D0 on the basis of the light reception data from the light-sensing section 13 is sampled in the A/D conversion section 15 at a timing in synchronization with the lighting period TB of a specific lighting section. Therefore, the backlight driving section 11 is controlled by the microcomputer 12 on the basis of light reception data by the illumination light from the lighting sections 4 positioned in a specific horizontal line in the light reception data D0, and the light emission amount of each lighting section 4 is controlled. Thereby, the size of the light reception data D1 sampled by the A/D conversion section 15 is not dependent on the distance between the light-sensing section 13 and the lighting section 4 which is turned on (in this case, the size is constantly uniform).

As described above, in the embodiment, the irradiating light Lout from the light source section 10 sequentially turning on the lighting sections 4 is received by the light-sensing section 13, and the light reception data D0 on the basis of the light reception data from the light-sensing section 13 is sampled in the A/D conversion section 15 at a timing in synchronization with the lighting period TB of a specific lighting section, so the backlight driving section 11 can be controlled by the microcomputer 12 on the basis of the light reception data by the illumination light from the lighting sections 4 positioned in a specific horizontal line in the light reception data D0, and the light emission amount of each lighting section 4 can be controlled. Therefore, the size of the light reception data D1 sampled by the A/D conversion section 15 can be prevented from depending on the distance between the light-sensing section 13 and the lighting section 4 which is turned on. Moreover, the complication of the configuration such as an increase in the number of parts can be prevented. Therefore, fluctuations in the intensity of the illumination light Lout can be further reduced with a simple configuration.

Moreover, the light source section 10 includes a plurality of red LEDs 1R, a plurality of green LEDs 1G and a plurality of blue LEDs 1B, and is an additive process backlight system 1 obtaining the illumination light Lout as a specific color light (a white light) by mixing a plurality of color lights (a red light, a green light and a blue light), so in addition to fluctuations in the intensity of the illumination light Lout, fluctuations in the chromaticity (color balance) of the illumination light Louts can be further reduced with a simple configuration.

Further, in the wiring between the I/V conversion section 14 and the A/D conversion section 15, the time constant CR by the resistance value and the capacity value can be set to be small to such an extent that the image quality of an displayed image on the liquid crystal panel 2 is not impaired, so difficulty in the light-on/off operation of each lighting section 4 following an image change when displaying motion pictures due to the large time constant can be prevented. Moreover, the arrangement area of the resistor or the capacity device can be reduced, so compared to the related art, the substrate area of the whole system can be reduced, and a size reduction of the system can be achieved.

Moreover, in the embodiment, as shown in FIG. 11, the light reception data D0 is selectively sampled from the lighting sections 4 positioned on the horizontal lines P1 and P2 at a close distance from the position of the light-sensing section 13; therefore, for example, compared to the case where the light reception data D0 is selectively sampled from the lighting sections 4 positioned in the horizontal lines P5 and P6 or the like at a long distance from the position of the light-sensing sectioin 13, the sensitivity of light reception data to be sampled can be improved, and the backlight driving section 11 can be controlled more delicately.

Further, the backlight system 1 is used as a backlight (an illumination system for liquid crystal display) of the liquid crystal display 3, so fluctuations in the intensity or chromaticity of the display light Dout emitted from the liquid crystal panel 2 can be further reduced as in the case of the illumination light Lout. Therefore, compared to the related art, the image quality of a displayed image can be improved.

Second Embodiment

Next, a second embodiment of the invention will be described below. In the embodiment, like components are denoted by like numerals as of the first embodiment and will not be further described.

Figure 12:
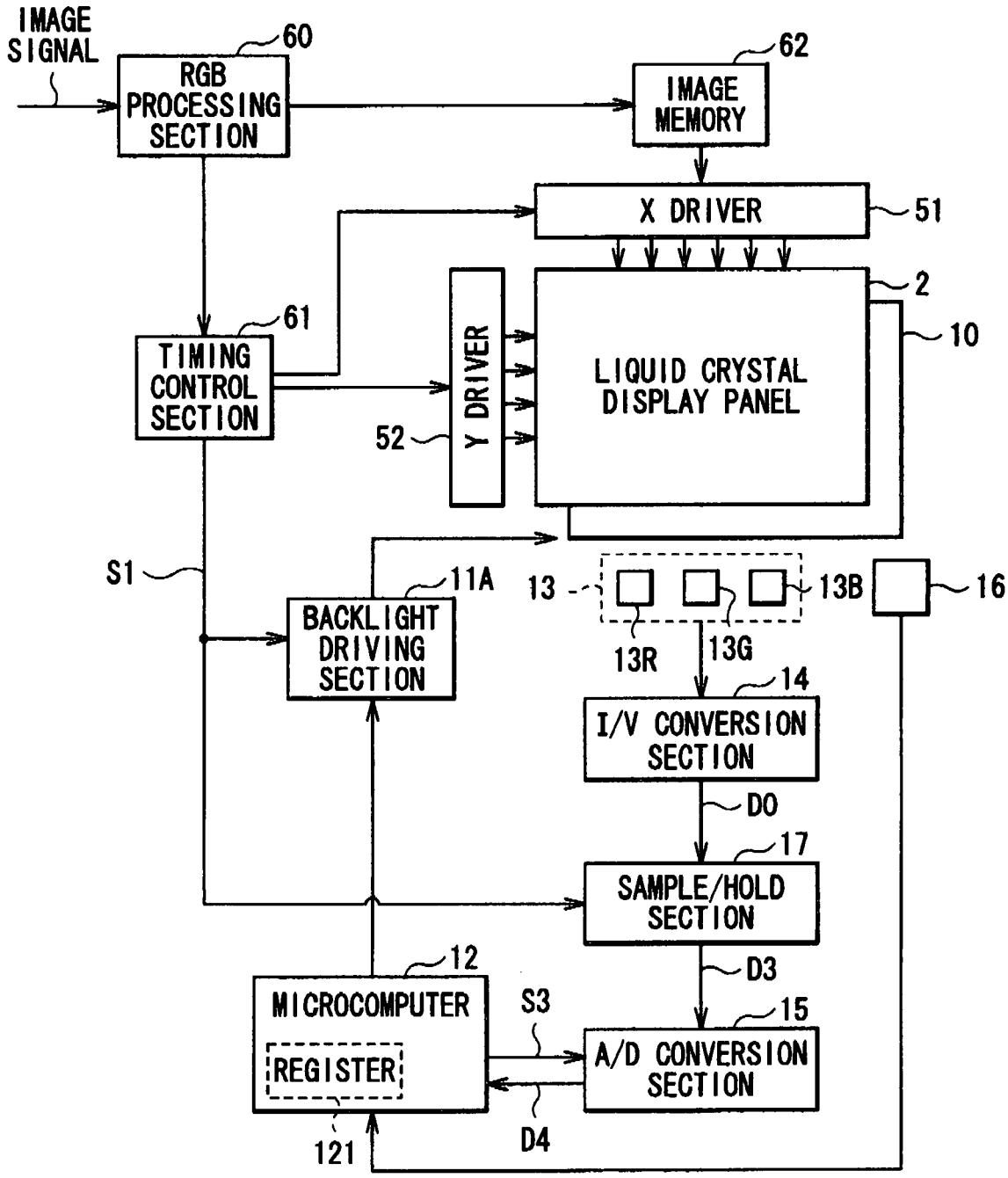
FIG. 12 is a block diagram showing the whole configuration of a liquid crystal display according to a second embodiment.

FIG. 12 shows the whole configuration of a liquid crystal display according to the embodiment. In the liquid crystal display, a backlight driving section 11A is arranged instead of the backlight driving section 11 in the liquid crystal display according to the first embodiment shown in FIG. 4, and a sample/hold section 17 is added, and the synchronizing signal S1 is supplied to the backlight driving section 11A and the sample/hold section 17 instead of the microcomputer 12.

Figure 13:
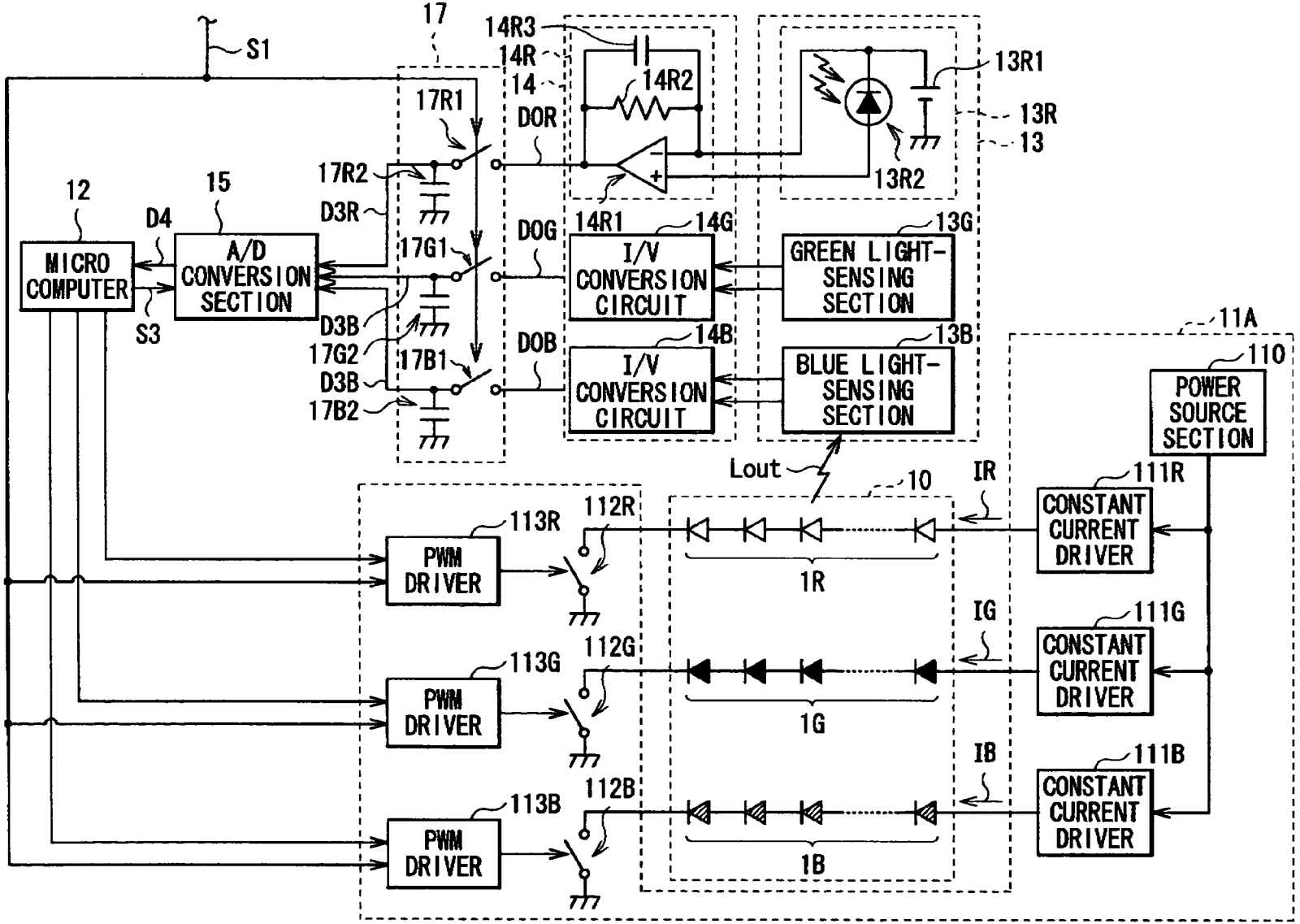
FIG. 13 is a block diagram showing detailed configurations of a driving section and a control section of the light source section shown in FIG. 12.

FIG. 13 shows specific configurations of the backlight driving section 11A, the sample/hold section 17 and the like, and corresponds to FIG. 6 described in the first embodiment.

The backlight driving section 11A includes PWM drivers 114R, 114G and 114B instead of the PWM drivers 113R, 113G and 113B of the backlight driving section 11 in the first embodiment, and inputs the synchronizing signal S1. In other words, the synchronizing signal S1 is inputted into the PWM drivers 114R, 114G and 114B instead of the microcomputer 12.

Figure 14:
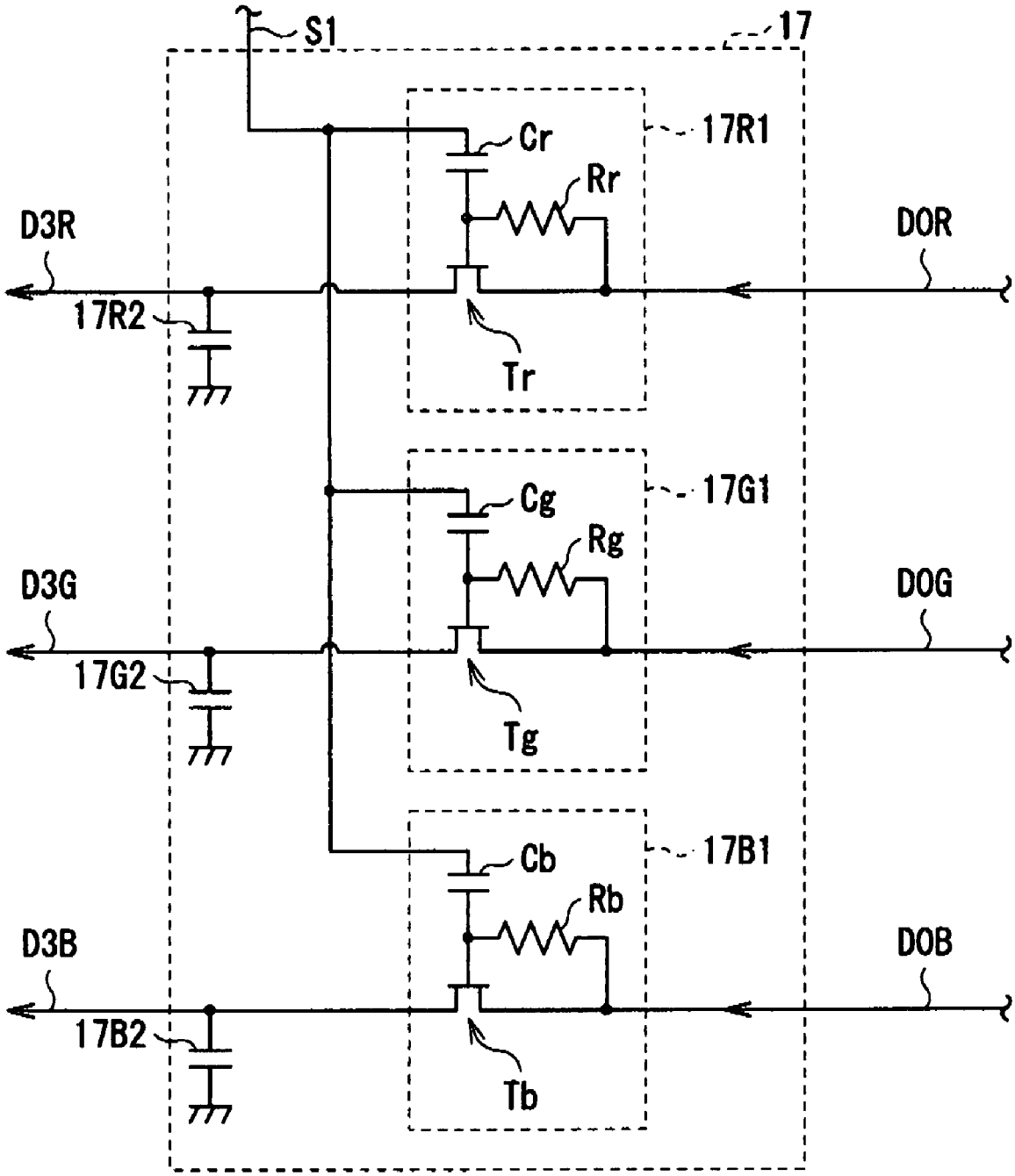
FIG. 14 is a circuit diagram for describing a detailed configuration example of a sample/hold section shown in FIG. 13.

Moreover, the sample/hold section 17 includes switching devices 17R1, 17G1 and 17B1 performing an on/off operation according to the synchronizing signal S1 and capacitors 17R2, 17G2 and 17B2. The switching devices 17R1, 17G1 and 17B1 are inserted between the I/V conversion sections 14R, 14G and 14B and the A/D conversion section 15, respectively, and the capacitors 17R2, 17G2 and 17B2 are arranged between terminals on a side closer to the A/D conversion section 15 of the switching devices 17R1, 17G1 and 17B1 and the ground, respectively. Moreover, the switching devices 17R1, 17G1 and 17B1 have, for example, a configuration shown in FIG. 14. More specifically, the switching device 17R1 includes a transistor Tr, a resistor Rr and a capacitor Cr, the switching device 17G1 includes a transistor Tg, a resistor Rg and a capacitor Cg, and the switching device 17B1 includes a transistor Tb, a resistor Rb and a capacitor Cb. With such a configuration, in the sample/hold section 17, the switching devices 17R1, 17G1 and 17B1 turn into an on state at a timing according to the synchronizing signal S1, thereby the light reception data D0R, D0G and D0B from the I/V conversion section 14 are captured and held in the capacitors 17R2, 17G2 and 17B2, respectively.

In this case, the sample/hold section 17 corresponds a specific example of "a holding means" in the invention, the switching devices 17R1, 17G1 and 17B1 correspond specific examples of "a switching device" in the invention, and the capacitors 17R2, 17G2 and 17B2 correspond to specific examples of "a capacity device" in the invention.

Next, the operations of the backlight system with such a configuration according to the embodiment and the liquid crystal display will be described in detail below. The basic operations of the backlight system and the liquid crystal display are the same as those described in the first embodiment, and will be further described.

Figure 15:
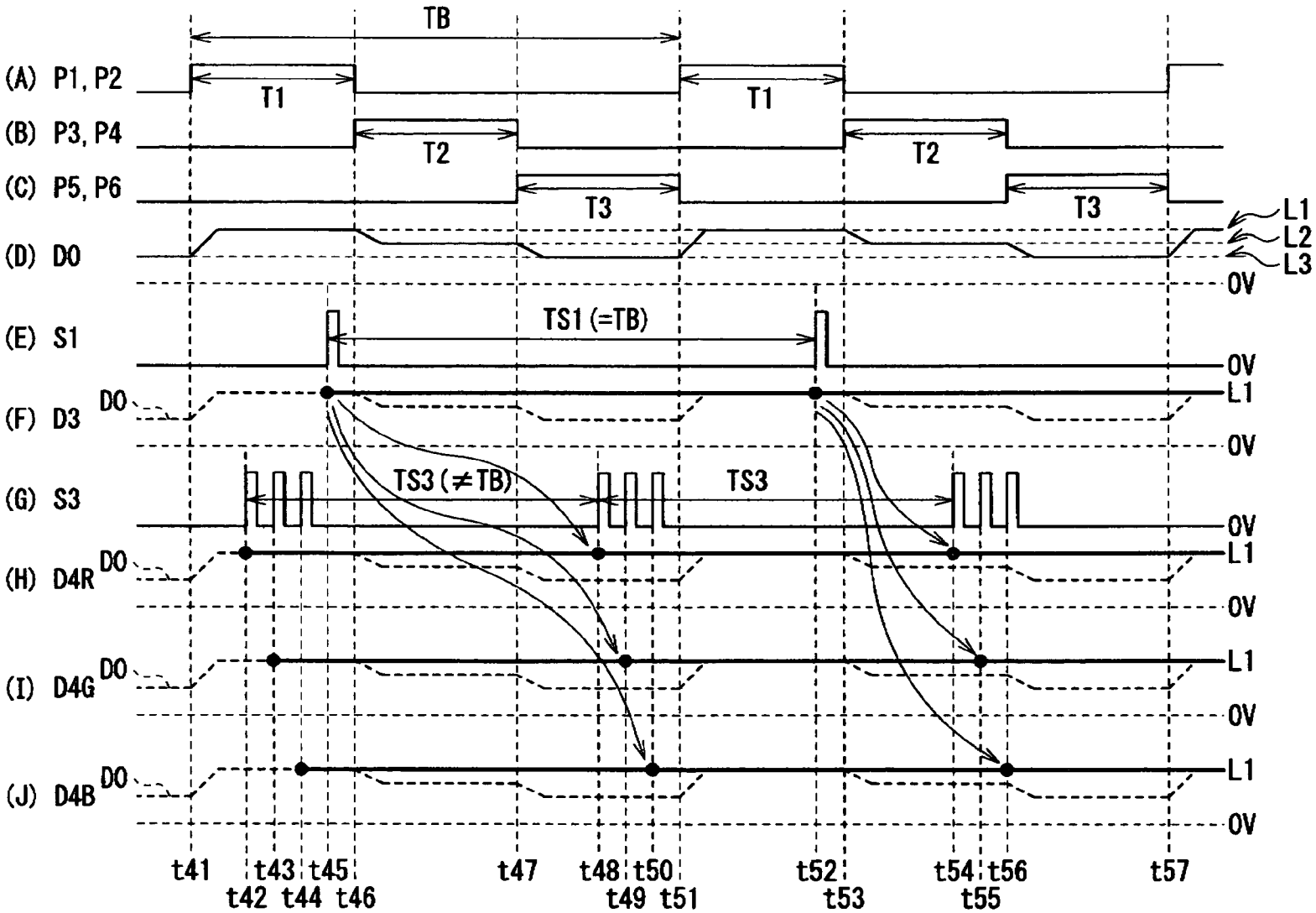
FIG. 15 is a timing waveform chart showing operation of the backlight system according to the second embodiment.

FIG. 15 shows a timing waveform chart of the operation of the backlight system according to the embodiment, and (A) to (C) show a lighting state in the horizontal lines P1 to P6, (D) shows the light receiving signal DO of an analog voltage inputted into the A/D conversion section 15, (E) shows the synchronizing signal S1, (F) shows the held light reception data D3 to be supplied from the sample/hold section 17 to the A/D conversion section 15, (G) shows a sampling signal S3 of the light reception data D3 to be supplied from the microcomputer 12 to the A/D conversion section 15, (H) to (J) show light reception data D4R, D4G and D4B of analog voltages sampled in the A/D conversion section 15.

In the backlight system according to the embodiment, unlike the first embodiment shown in FIG. 11, the lighting period (blinking period) TB of the lighting section 4 and the sampling period TS3 of the sampling signal S3 do not synchronize each other, and are different. It is because in the embodiment, the synchronizing signal SI is not supplied to the microcomputer 12. In the embodiment, the lighting period TB of the lighting section 4 and a period (a sample/hold period) in which the light reception data D0R, D0G and D0B are captured and held in the sample/hold section 17 synchronize each other and are the same (=the period of the synchronizing signal S1). It is because in the embodiment, the synchronizing signal Si is supplied to the sample/hold section 17 and the PWM drivers 114R, 114G and 114B in the backlight driving section 11A.

Therefore, at first, for example, when the synchronizing signal Si turns into "H" at a timing t45, the switching devices 17R1, 17G1 and 17B1 in the sample/hold section 17 turn into an on state, and the light reception data D0 on the basis of the irradiating light from the horizontal lines P1 and P2 corresponding to the period T1 is held in the capacitors 17R2, 17G2 and 17B2 to become the light reception data D3. Then, after that, when the synchronizing signal Si turn back to "L", and the switching devices 17R1, 17G1 and 17B1 turns into an off state, irrespective of the value of the light reception data DO from the I/V conversion section 14, the held light reception data D3 has a constant value. Therefore, even in the case where in a period (a period from timings t45 to t52) until the synchronizing signal S1 turns into "H" again, and the switching devices 17R1, 17G1 and 17B1 turn into an on state, the lighting period TB of the lighting section 4 and the sampling period TS4 of the sampling signal S3 in the A/D conversion section 15 do not synchronize each other, and it is not clear at which timing the sampling signal S3 turns into "H", in the A/D conversion section 15, the light reception data D3 held constant in the sample/hold section 17 is sampled instead of the light reception data D0 of which the value is changed in the periods T1 to T3, so as shown by an arrow in FIG. 15, the sampled light reception data D4R, D4G and D4B become constant and stable. Even in the next period from timings t52 to t56, the same operation as that in the period from the timings t45 to t50 is performed.

Thus, in the backlight system according to the embodiment, the light reception data D0 on the basis of the light reception data from the light-sensing section 13 is held in the sample/hold section 17 at a timing in synchronization with the lighting period TB of a specific lighting section, and the held light reception data D3 is sampled in the A/D conversion section 15 to be supplied to the microcomputer 12. Therefore, as in the case of the first embodiment, the size of the light reception data D4 sampled in the A/D conversion section 15 is not dependent on the distance between the light-sensing section 13 and the lighting section 4 which is turned on (in this case, the size is constantly uniform).

As described above, in the embodiment, the light reception data D0 on the basis of the light reception data from the light-sensing section 13 is held in the sample/hold section 17 at a timing in synchronization with the lighting period TB of a specific lighting section, and the held light reception data D3 is sampled in the A/D conversion section 15 to be supplied to the microcomputer 12, so as in the case of the first embodiment, the size of the light reception data D4 sampled in the A/D conversion section 15 can be prevented from depending on the distance between the light-sensing section 13 and the lighting section 4 which is turned on. Moreover, the compilation of the configuration such as an increase in the number of parts can be prevented. Therefore, as in the case of the first embodiment, fluctuations in the intensity and chromaticity of the illumination light Lout can be further reduced with a simple configuration.

Moreover, as in the case of the first embodiment, the backlight system is used as a backlight (a illumination system for liquid crystal display) of the liquid crystal display, so as in the case of the illumination light Lout, fluctuations in the intensity or chromaticity of the display light Dout emitted from the liquid crystal panel 2 can be further reduced. Therefore, compared to the related art, the image quality of a displayed image can be improved.

Further, unlike the first embodiment, in the embodiment, the synchronizing signal S1 is not supplied to the microcomputer 12, and is controlled by hardware instead of software, so it is not necessary to change a timing or the like for control in the microcomputer 12. More specifically, in the embodiment, the sampling signal S3 to be supplied to the A/D conversion section 15 can be set in an arbitrary sampling period, and unlike the first embodiment, it is not necessary for the sampling period to synchronize the lighting period TB of the lighting section 4. Therefore, compared to the first embodiment, the backlight driving section 11 can be controlled more easily.

Although the present invention is described referring to the first and the second embodiments, the invention is not limited to the embodiment, and can be variously modified.

Figure 16:
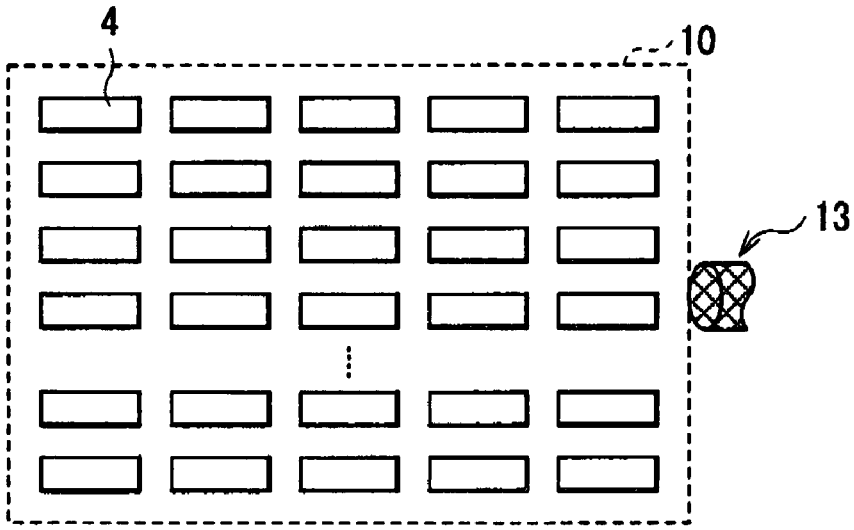
FIG. 16 is a schematic plan view showing the arrangement of a light receiving section according to a modification of the invention.
Figure 17:
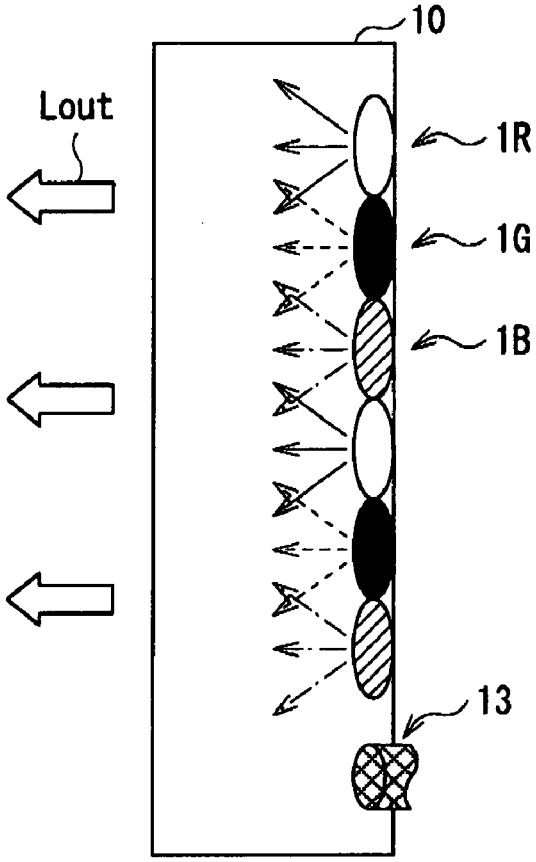
FIG. 17 is a schematic sectional view showing the arrangement of a light receiving section according to another modification of the invention.

For example, in the above-described embodiments, the case where the light-sensing section 13 is arranged on the top end of the light source section 10 as shown in FIGS. 8A, 8B and 8C is described; however, the position of the light-sensing section 13 is not limited to this case, and the light-sensing section 13 may be arranged, for example, on the bottom end of the light source section 10, and, for example, as shown in FIGS. 16 and 17, the light-sensing section 13 may be arranged on a side (refer to FIG. 16) or a back side (refer to FIG. 17) of the light source section 10. In the case where the light-sensing section 13 is arranged on the back side of the light source section 10 as shown in FIG. 17, compared to the case where the light-sensing section 13 is arranged on the top end, the bottom end or the side of the light source section 10, the illumination light Lout with an equalized light amount can be received.

Moreover, in the above-described embodiments, the backlight driving section 11 is controlled using the light reception data from one light-sensing section 13; however, for example, a plurality of light receiving sections are arranged in different positions relative to the light source section 10, and the backlight driving section 11 may be controlled using an average value of light reception data from the plurality of light receiving sections.

In the above-described embodiments, the case where the light reception data D0 is selectively sampled from the lighting sections 4 positioned on the horizontal lines P1 and P2 closest to the position of the light-sensing section 13 is described; however, the positions of the horizontal lines in the light source section 10 selectively sampling the light reception data D0 are not limited to the case, and the light reception data D0 may be selectively sampled from the lighting sections 4 positioned on the horizontal lines P5 and P6 or the like far from the position of the light-sensing section 13. In such a configuration, compared to the case where the light reception data D0 is selectively sampled from the lighting sections 4 positioned on a horizontal line close to the light-sensing section 13, a spatial integral effect in the illumination light Lout can be improved, and light reception data with higher plane uniformity can be obtained. Therefore, the light emission amount in the light source 10 can be more uniform in a plane.

In the above-described embodiments, as an example of the synchronizing signal S1, the vertical synchronizing signal Vsync when displaying an image on the liquid crystal panel 2 is described; however, for example, the backlight driving section 11 may be controlled using a synchronizing signal with a frequency equal to ½ of the frequency of the vertical synchronizing signal Vsync or a synchronizing signal with a frequency equal to ¼ of the frequency of the vertical synchronizing signal Vsync.

In the above-described embodiments, the case where the light source section 10 performs line sequential lighting on a two-horizontal-line basis is described; however, for example, line sequential lighting may be performed on an any number of horizontal line basis such as on a one-horizontal-line basis.

In the above-described embodiments, the case where the light source section 10 includes the red LED 1R, the green LED 1G and the blue LED 1B is described; however, in addition to them (or instead of them), the light source section 10 may include an LED emitting another color light. In the case where four or more color lights are used, a color reproduction range can be expanded, and more various colors can be displayed.

In the above-described embodiments, the additive process backlight system 1 in which the light source section 10 includes a plurality of red LEDs 1R, a plurality of green LEDs 1G and a plurality of blue LEDs 1B, and the illumination light Lout as a specific color light (a white light) is obtained by mixing a plurality of color lights (a red light, a green light and a blue light) is described; however, the invention may be applied to a backlight system in which a light source section includes one kind of LED, and a single-color illumination light is emitted. In the backlight system with such a configuration, fluctuations in the intensity of the illumination light can be further reduced with a simple configuration.

In the above-described embodiments, the case where the liquid crystal display 3 is a transmissive liquid crystal display including the backlight system 1 is described; however, the light source device according to the embodiment of the invention may be used as a front light system to form a reflective liquid crystal display.

For example, the light source device according to the embodiments of the invention is applicable to not only an illumination system for liquid crystal display but also any other light source device such as an illumination device.

It should be understood by those skilled in the art that various modifications, combinations, sub-combinations and alterations may occur depending on design requirements and other factors insofar as they are within the scope of the appended claims or the equivalents thereof.

The invention claimed is:

1. A light source device comprising:

a light source including a plurality of lighting sections controllable independently of one another;

a drive means for driving the light source so that the lighting sections are sequentially turned on;

a light-sensing device to receive light from the light source in which the lighting sections are sequentially turned on;

a control means for controlling the drive means on the basis of a light receiving signal obtained by the light-sensing device from a specific lighting section so as to control the light emission amount of each lighting section; and a sampling means for sampling the light receiving signal from the light-sensing device at a timing in synchronization with a lighting period of the specific lighting section to supply the control means with the light receiving signal sampled.

2. The light source device according to claim 1, comprising:

a holding means for obtaining and holding the light receiving signal from the light-sensing device at a timing in synchronization with the lighting period of the specific lighting section;

in which the sampling means is operable to sample the light receiving signal held by the holding means to supply the sampled light receiving signal to the control means.

3. The light source device according to claim 2, wherein the holding means includes:

a switching device turning into an on state at a timing in synchronization with the lighting period; and a capacity device electrically storing a light receiving signal obtained from the light-sensing device through the switching device.

4. The light source device according to claim 1, wherein the light source device is an additive process light source device obtaining a specific color light by mixing a plurality of color lights, each lighting section in the light source includes a plurality of kinds of light-emitting devices emitting different color lights, the light-sensing device includes a plurality of kinds of light-sensing devices each extracting and receiving each color component from a mixed color light produced by mixing color lights from the plurality of kinds of light-emitting devices, and the control means controls the drive means for every kinds of light-sensing devices on the basis of a light receiving signal from the specific lighting section, and controls the light emission amounts of the plurality of kinds of light-emitting devices.

5. The light source device according to claim 1, applied to a liquid crystal panel which modulates incident light on the basis of an image signal, wherein the light source device is used as an illumination system for the liquid crystal panel which supplies light from each lighting section as the incident light to the liquid crystal panel, the amount of the light from each lighting section being controlled by the control means.

6. The light source device according to claim 5, in which the lighting period of the specific lighting section corresponds to a display period of the liquid crystal panel.

7. The light source device according to claim 5, comprising:

a holding means for obtaining and holding a light receiving signal from the light-sensing device at a timing in synchronization with the lighting period of the specific lighting section corresponding to a display period of the liquid crystal panel;

in which the sampling means is operable to sample the light receiving signal held by the holding means to supply the control means with the light receiving signal sampled.

8. A light source driving device, being applied to a light source including a plurality of lighting sections controllable independently of one another, the light source driving device comprising:

a drive means for driving the light source so that the lighting sections are sequentially turned on;

a light-sensing device receiving light from the light source in which the lighting sections are sequentially turned on;

a control means for controlling the drive means on the basis of a light receiving signal obtained by the light-sensing device from a specific lighting section so as to control the light emission amount of each lighting section; and a sampling means for sampling the light receiving signal from the light-sensing device at a timing in synchronization with a lighting period of the specific lighting section to supply the control means with the light receiving signal sampled.

9. A light emission amount control device, being applied to a light source device, the light source device including a light source and a drive means, the light source including a plurality of lighting sections controllable independently of one another, the drive means for driving the light source so that the lighting sections are sequentially turned on, the light emission amount control device comprising:

a light-sensing device receiving light from the light source in which the lighting sections are sequentially turned on;

a control means for controlling the drive means on the basis of a light receiving signal obtained by the light-sensing device from a specific lighting section so as to control the light emission amount of each lighting section; and a sampling means for sampling the light receiving signal from the light-sensing device at a timing in synchronization with a lighting period of the specific lighting section to supply the control means with the light receiving signal sampled.

10. A liquid crystal display comprising:

an illumination means for emitting light; and a liquid crystal panel modulating the light emitted from the illumination means on the basis of an image signal, wherein the illumination means includes a light source including a plurality of lighting sections controllable independently of one another, a drive means for driving the light source so that the lighting sections are sequentially turned on, a light-sensing device receiving light from the light source in which the lighting sections are sequentially turned on, a control means for controlling the drive means on the basis of a light receiving signal obtained by the light-sensing device from a specific lighting section so as to control the light emission amount of each lighting section, and a sampling means for sampling the light receiving signal from the light-sensing device at a timing in synchronization with a lighting period of the specific lighting section to supply the control means with the light receiving signal sampled.

11. A light source device comprising:

a light source including a plurality of lighting sections controllable independently of one another;

a drive section driving the light source so that the lighting sections are sequentially turned on;

a light-sensing device receiving light from the light source in which the lighting sections are sequentially turned on;

a control section controlling the drive section on the basis of a light receiving signal obtained by the light-sensing device from a specific lighting section so as to control the light emission amount of each lighting section; and a sampling section to sample the light receiving signal from the light-sensing device at a timing in synchronization with a lighting period of the specific lighting section to supply the control section with the light receiving signal sampled.

12. A light source driving device, being applied to a light source including a plurality of lighting sections controllable independently of one another, the light source driving device comprising:

a drive section driving the light source so that the lighting sections are sequentially turned on;

a light-sensing device receiving light from the light source in which the lighting sections are sequentially turned on;

a control section controlling the drive section on the basis of a light receiving signal obtained by the light-sensing device from a specific lighting section so as to control the light emission amount of each lighting section; and a sampling section to sample the light receiving signal from the light-sensing device at a timing in synchronization with a lighting period of the specific lighting section to supply the control section with the light receiving signal sampled.

13. A light emission amount control device, being applied to a light source device, the light source device including a light source and a drive section, the light source including a plurality of lighting sections controllable independently of one another, the drive section driving the light source so that the lighting sections are sequentially turned on, the light emission amount control device comprising:

a light-sensing device receiving light from the light source in which the lighting sections are sequentially turned on;

a control section controlling the drive section on the basis of a light receiving signal obtained by the light-sensing device from a specific lighting section so as to control the light emission amount of each lighting section; and a sampling section to sample the light receiving signal from the light-sensing device at a timing in synchronization with a lighting period of the specific lighting section to supply the control section with the light receiving signal sampled.

14. The light source device according to claim 1, in which the control means is operable to provide a sampling signal having a sampling time period to the sampling means, in which a time period of the lighting period is constituted by a plurality of sub-periods and is the same as the sampling time period of the sampling signal, and in which the sampling means in response to the sampling signal is operable to sample the respective light receiving signal for each of the plurality of lighting sections from the light-sensing device during only one of the sub-periods of the time period of the lighting period.

* * * * *